US009630289B2

(12) United States Patent
Togawa et al.

(10) Patent No.: US 9,630,289 B2
(45) Date of Patent: Apr. 25, 2017

(54) POLISHING METHOD INVOLVING A POLISHING MEMBER POLISHING AT ANGLE TANGENT TO THE SUBSTRATE ROTATIONAL DIRECTION

(71) Applicant: EBARA CORPORATION, Tokyo (JP)

(72) Inventors: Tetsuji Togawa, Tokyo (JP); Atsushi Yoshida, Tokyo (JP); Michiyoshi Yamashita, Tokyo (JP)

(73) Assignee: Ebara Corporation, Tokyo (JP)

( * ) Notice: Subject to any disclaimer, the term of this patent is extended or adjusted under 35 U.S.C. 154(b) by 484 days.

(21) Appl. No.: 14/034,468

(22) Filed: Sep. 23, 2013

(65) Prior Publication Data

US 2014/0094095 A1 Apr. 3, 2014

(30) Foreign Application Priority Data

Sep. 24, 2012 (JP) ..... 2012-209500
Sep. 25, 2012 (JP) ..... 2012-210650

(51) Int. Cl.

| | |
|---|---|
| ***B24B 9/06*** | (2006.01) |
| *B24B 21/00* | (2006.01) |
| *B24B 21/20* | (2006.01) |
| *B24B 9/10* | (2006.01) |

(52) U.S. Cl.

CPC ..... *B24B 9/065* (2013.01); *B24B 21/002* (2013.01); *B24B 9/102* (2013.01); *B24B 21/00* (2013.01); *B24B 21/20* (2013.01)

(58) Field of Classification Search

CPC ..... B24B 21/002; B24B 21/004; B24B 21/20; B24B 21/08; B24B 9/065; B24B 9/08; B24B 9/085; B24B 9/10; B24B 9/102; B24B 9/107; B24B 9/14; B24B 9/142

USPC ..... 451/43, 44; 438/959

See application file for complete search history.

(56) References Cited

U.S. PATENT DOCUMENTS 1,365,583 A * 1/1921 Brown ..... B24B 21/002 451/310
3,715,839 A * 2/1973 Heesemann ..... B24B 21/002 451/168
3,922,820 A * 12/1975 Wiltshire ..... B24B 21/002 451/304
5,868,857 A * 2/1999 Moinpour ..... B08B 1/008 134/6

(Continued)

FOREIGN PATENT DOCUMENTS

CN 101450457 A 6/2009
DE 19821982 A1 * 1/2000 ..... B24B 21/002

(Continued)

*Primary Examiner* — Joseph J Hail
*Assistant Examiner* — Arman Milanian
(74) *Attorney, Agent, or Firm* — Baker & Hostetler LLP

(57) ABSTRACT

A polishing method includes rotating a substrate, performing a first polishing process of pressing a polishing tape against an edge portion of the substrate by a pressing member, with a portion of the polishing tape projecting from the pressing member inwardly in a radial direction of the substrate, to polish the edge portion of the substrate and bend the portion of the polishing tape along the pressing member, and performing a second polishing process of pressing the bent portion of the polishing tape inwardly in the radial direction of the substrate by the pressing member to further polish the edge portion of the substrate.

28 Claims, 54 Drawing Sheets

(56) References Cited

U.S. PATENT DOCUMENTS 6,110,391 A * 8/2000 Takei ..... H01L 21/304 216/2
6,402,596 B1 * 6/2002 Hakomori ..... B24B 21/002 451/168
6,629,875 B2 10/2003 Steere
6,641,464 B1 * 11/2003 Steere, III ..... B24B 21/002 451/287
7,014,529 B1 * 3/2006 Kubota ..... B24B 37/015 451/168
7,351,131 B2 * 4/2008 Nakamura ..... B24B 9/065 257/E21.237
7,621,799 B2 * 11/2009 Sakairi ..... B24B 9/065 451/299
8,641,480 B2 * 2/2014 Nakanishi ..... B24B 55/00 451/168
2001/0011002 A1 * 8/2001 Steere, III ..... B24B 9/065 451/168
2002/0019200 A1 * 2/2002 Ikeno ..... B24B 1/00 451/42
2002/0045348 A1 * 4/2002 Arai ..... B24B 7/228 438/690
2002/0098787 A1 * 7/2002 Kunisawa ..... B24B 9/065 451/307
2002/0142707 A1 * 10/2002 Shimada ..... B24B 9/065 451/44
2002/0164930 A1 * 11/2002 Hakomori ..... B24B 37/042 451/44
2004/0072504 A1 * 4/2004 Tada ..... B24B 7/17 451/41
2004/0185751 A1 * 9/2004 Nakanishi ..... B24B 21/002 451/5
2007/0072393 A1 * 3/2007 Aspar ..... H01L 21/304 438/459
2009/0004952 A1 * 1/2009 Takahashi ..... B24B 9/065 451/44
2009/0090451 A1 * 4/2009 Yamamoto ..... H01L 21/67132 156/64
2009/0142992 A1 * 6/2009 Takahashi ..... B24B 9/065 451/9
2009/0227189 A1 * 9/2009 Maeda ..... B24B 21/004 451/303
2009/0275269 A1 * 11/2009 Sakairi ..... B24B 9/065 451/44
2010/0112909 A1 * 5/2010 Yamaguchi ..... B24B 9/065 451/44
2011/0097874 A1 * 4/2011 Broekaart ..... H01L 21/304 438/459
2011/0136411 A1 * 6/2011 Nakanishi ..... B24B 9/065 451/41
2011/0207294 A1 8/2011 Nakanishi et al.
2011/0306282 A1 * 12/2011 Fischer ..... B24B 9/18 451/296
2012/0252320 A1 10/2012 Seki
2014/0213152 A1 * 7/2014 Chang ..... B24B 9/065 451/44
2014/0213155 A1 * 7/2014 Togawa ..... B24B 21/008 451/44

FOREIGN PATENT DOCUMENTS

JP H04263425 A * 9/1992 ..... H01L 21/02
JP H0897111 A * 4/1996 ..... H01L 21/02
JP H09186234 * 7/1997 ..... H01L 21/304
JP 2011-161625 8/2011
JP 2011-171647 9/2011
JP 2011-224680 11/2011

* cited by examiner

BEFORE
REPLACING
PRESSING PAD

BEFORE
REPLACING
PRESSING PAD

AFTER
REPLACING
PRESSING PAD

POLISHING METHOD INVOLVING A POLISHING MEMBER POLISHING AT ANGLE TANGENT TO THE SUBSTRATE ROTATIONAL DIRECTION

CROSS REFERENCE TO RELATED APPLICATIONS

This document claims priorities to Japanese Application Number 2012-209500, filed Sep. 24, 2012 and Japanese Patent Application Number 2012-210650, filed Sep. 25, 2012, the entire contents of which are hereby incorporated by reference.

BACKGROUND OF THE INVENTION

Field of the Invention

The present invention relates to a method of polishing a substrate, such as a wafer. More particularly, the present invention relates to a method of polishing a peripheral portion of a substrate by pressing a polishing tool, such as a polishing tape, against the peripheral portion.

Description of the Related Art

A polishing apparatus, which has a polishing tool (e.g., a polishing tape or a fixed abrasive), is used for polishing a peripheral portion of a wafer. This type of polishing apparatus is configured to bring the polishing tool into contact with the peripheral portion of the wafer, while rotating the wafer, to thereby polish the peripheral portion. In this specification, the peripheral portion of the wafer is defined as a region including a bevel portion which is the outermost portion of the wafer and a top edge portion and a bottom edge portion located radially inwardly of the bevel portion.

FIG. 52A and FIG. 52B are enlarged cross-sectional views each showing the peripheral portion of the wafer. More specifically, FIG. 52A shows a cross-sectional view of a so-called straight-type wafer, and FIG. 52B shows a cross-sectional view of a so-called round-type wafer. In the wafer W shown in FIG. 52A, the bevel portion is an outermost circumferential surface of the wafer W (indicated by a symbol B) that is constituted by an upper slope (an upper bevel portion) P, a lower slope (a lower bevel portion) Q, and a side portion (an apex) R. In the wafer W shown in FIG. 52B, the bevel portion is a portion (indicated by a symbol B) having a curved cross section and forming an outermost circumferential surface of the wafer W. The top edge portion is a flat portion E1 located radially inwardly of the bevel portion B. The bottom edge portion is a flat portion E2 located opposite the top edge portion and located radially inwardly of the bevel portion B. The top edge portion E1 and the bottom edge portion E2 may be collectively referred to as edge portion. The edge portion may include a region where devices are formed.

In a fabrication process of SOI (Silicon on Insulator) substrate, there is a need to form a vertical surface and a horizontal surface on the edge portion of the wafer W, as shown in FIG. 53. A cross section of such edge portion is achieved by a polishing process as illustrated in FIG. 54. Specifically, while the wafer W is rotated, a pressing pad 300 presses an edge of a polishing tape 301 against the edge portion of the wafer W to thereby polish it. The polishing tape 301 has its lower surface serving as a polishing surface that holds abrasive grains thereon. This polishing surface is disposed parallel to the wafer W. With the edge of the polishing tape 301 located on the edge portion of the wafer W, the pressing pad 300 presses the polishing surface of the polishing tape 301 against the edge portion of the wafer W to thereby form a right-angle cross section as shown in FIG. 53, i.e., the vertical surface and the horizontal surface on the edge portion of the wafer W.

However, as shown in FIG. 55A, the above-mentioned vertical surface may be roughened because the vertical surface is formed by grinding the edge portion of the wafer W with the edge of the polishing tape 301. In addition, as shown in FIG. 55B through FIG. 55D, the profile of the vertical surface may vary before and after replacement of the pressing pad 300 which is a consumable.

In the fabrication process of the SOI substrate, it may be preferable to form, instead of the vertical surface shown in FIG. 53, a reverse tapered surface as shown in FIG. 56. However, it is difficult for the polishing method illustrated in FIG. 54 to form such a reverse tapered surface.

Further, since a contact area of the polishing tape and the horizontal surface differs depending on a position in the horizontal surface of the wafer edge portion, a part of the resultant horizontal surface may be inclined. This problem will be discussed with reference to figures. FIG. 57 is a plan view showing the pressing pad 300 and the polishing tape 301 shown in FIG. 54. The wafer W has a circular shape, while the pressing pad 300 has a rectangular shape. As a result, a contact length (i.e., a polishing area) of the polishing tape 301 and the wafer W is different between a radially-inward region and a radially-outward region in the horizontal surface of the wafer edge portion, as indicated by broken lines shown in FIG. 57. As a result, as shown in FIG. 58, the radially-inward region in the horizontal surface may be inclined.

SUMMARY OF THE INVENTION

A first object of the present invention is to provide a polishing method capable of forming a smooth vertical surface on an edge portion of a substrate, such as a wafer.

A second object of the present invention is to provide a polishing method capable of forming a reverse tapered surface on an edge portion of a substrate, such as a wafer.

A third object of the present invention is to provide a polishing method capable of forming a flat horizontal surface on an edge portion of a substrate, such as a wafer.

In order to achieve the above objects, a first embodiment provides a polishing method, including: rotating a substrate; performing a first polishing process of pressing a polishing tape against an edge portion of the substrate by a pressing member, with a portion of the polishing tape projecting from the pressing member inwardly in a radial direction of the substrate, to polish the edge portion of the substrate and bend the portion of the polishing tape along the pressing member; and performing a second polishing process of pressing the bent portion of the polishing tape inwardly in the radial direction of the substrate by the pressing member to further polish the edge portion of the substrate.

A second embodiment provides a polishing method, including: rotating a substrate; performing a first polishing process of pressing a polishing tape against an edge portion of the substrate by a pressing member, with a portion of the polishing tape projecting from the pressing member inwardly in a radial direction of the substrate, to polish the edge portion of the substrate; after the first polishing process, pressing the portion of the polishing tape against the edge portion of the substrate to bend the portion of the polishing tape along the pressing member; and performing a second polishing process of pressing the bent portion of the polishing tape inwardly in the radial direction of the substrate by the pressing member to further polish the edge portion of the substrate.

A third embodiment provides a polishing method, including: rotating a substrate; performing a first polishing process of pressing a first polishing tape against an edge portion of the substrate by a first pressing member, with a portion of the first polishing tape projecting from the first pressing member inwardly in a radial direction of the substrate, to polish the edge portion of the substrate; performing positioning of a second polishing tape and a second pressing member such that a portion of the second polishing tape projects from the second pressing member inwardly in the radial direction of the substrate; pressing the portion of the second polishing tape against an angular portion formed on the edge portion of the substrate to bend the portion of the second polishing tape along the second pressing member, the angular portion having been formed in the first polishing process; and performing a second polishing process of pressing the bent portion of the second polishing tape inwardly in the radial direction of the substrate by the second pressing member to further polish the edge portion of the substrate.

A fourth embodiment provides a polishing method, including: rotating a substrate; performing a first polishing process of pressing a polishing tool against an edge portion of the substrate to polish the edge portion of the substrate; and after the first polishing process, performing a second polishing process of pressing the polishing tool inwardly in the radial direction of the substrate to further polish the edge portion of the substrate.

A fifth embodiment provides a polishing method, including: rotating a substrate; performing a slide-polishing process of pressing a polishing tape against an edge portion of the substrate by a pressing member while moving the polishing tape and the pressing member inwardly in a radial direction of the substrate until the polishing tape reaches a predetermined stop position; repeating the slide-polishing process; and shifting slightly the stop position inwardly in the radial direction of the substrate each time the slide-polishing process is performed.

A sixth embodiment provides a polishing method, including: locating a pressing member in a position displaced in a tangential direction of a substrate by a predetermined distance from an origin position that lies on a center line extending in a radial direction from a center of the substrate, said tangential direction being perpendicular to the center line; rotating the substrate; and pressing a polishing tape against an edge portion of the substrate by the pressing member in the displaced position to form a horizontal surface on the edge portion of the substrate.

A seventh embodiment provides a polishing method, including: locating a polishing tool in a position displaced in a tangential direction of a substrate by a predetermined distance from an origin position that lies on a center line extending in a radial direction from a center of the substrate, said tangential direction being perpendicular to the center line; rotating the substrate; and pressing the polishing tool in the displaced position against an edge portion of the substrate to form a horizontal surface on the edge portion of the substrate.

According to the first embodiment through the fourth embodiment, the first polishing process can form the vertical surface on the edge portion of the substrate, and the second polishing process can smooth the vertical surface.

According to the fifth embodiment, the reverse tapered surface as shown in FIG. 56 can be formed on the edge portion of the substrate.

According to the sixth embodiment and the seventh embodiment, the contact area of the polishing tape and the outer region in the horizontal surface of the substrate edge portion can be reduced, without changing the contact area of the inner region in the horizontal surface and the polishing tape, by displacing the position of the pressing member in the tangential direction of the substrate. Therefore, the flat horizontal surface can be formed on the substrate edge portion.

DETAILED DESCRIPTION OF EMBODIMENTS

Embodiments of the present invention will now be described in detail with reference to the drawings.

Figure 1:
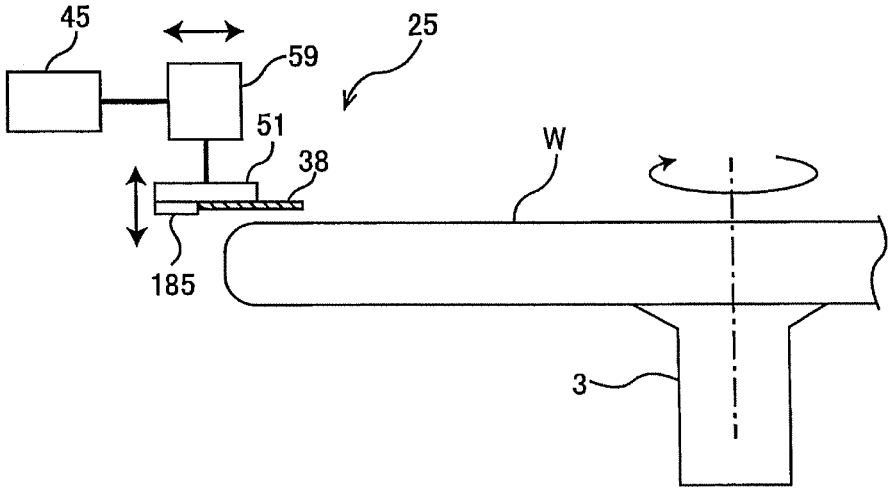
FIG. 1 is a schematic view illustrating a polishing apparatus for carrying out an embodiment of a polishing method.
Figure 2:
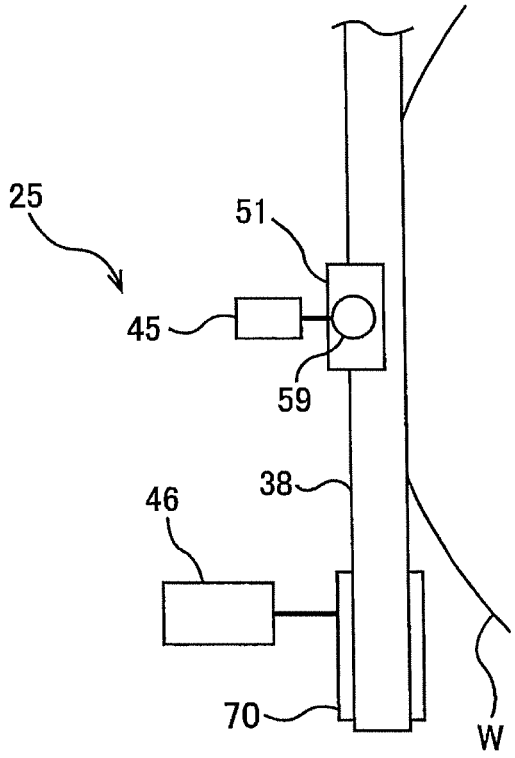
FIG. 2 is a plan view of the polishing apparatus shown in FIG. 1.

FIG. 1 is a schematic view illustrating a polishing apparatus for carrying out an embodiment of a polishing method, and FIG. 2 is a plan view of the polishing apparatus shown in FIG. 1. The polishing apparatus includes a wafer holder 3 for holding and rotating a wafer W as a substrate, and a polishing unit 25 for polishing an edge portion of the wafer W held by the wafer holder 3.

The polishing unit 25 includes a polishing-tape support mechanism 70 for supporting a polishing tape 38, a pressing pad (pressing member) 51 for pressing the polishing tape 38 against the edge portion of the wafer W, a vertically moving mechanism 59 for moving the pressing pad 51 in a direction perpendicular to the wafer surface, a radially moving mechanism 45 for moving the pressing pad 51 and the vertically moving mechanism 59 in a radial direction of the wafer W, and a tape moving mechanism 46 for moving the polishing tape 38 and the polishing-tape support mechanism 70 in the radial direction of the wafer W.

The radially moving mechanism 45 and the tape moving mechanism 46 can be operated independently of each other. Therefore, a relative position between the pressing pad 51 and the polishing tape 38 in the radial direction of the wafer W can be adjusted by the radially moving mechanism 45 and the tape moving mechanism 46. A combination of pneumatic cylinders, a combination of a servo motor and a ball screw, or the like can be used as the vertically moving mechanism 59, the radially moving mechanism 45, and the tape moving mechanism 46.

The polishing tape 38 is supported by the polishing-tape support mechanism 70 such that a polishing surface of the polishing tape 38 lies parallel to the surface of the wafer W and the polishing surface faces the edge portion of the wafer W. One surface (a lower surface) of the polishing tape 38 constitutes the polishing surface having abrasive particles fixed thereto. The polishing tape 38 is a long polishing tool, and is disposed along a tangential direction of the wafer W. The pressing pad 51 is a pressing member for pressing the polishing tape 38 against the edge portion of the wafer W, and is disposed above the edge portion of the wafer W. A tape stopper 185 for restricting a horizontal movement of the polishing tape 38 is fixed to a bottom of the pressing pad 51. This tape stopper 185 may be omitted.

Figure 3A:
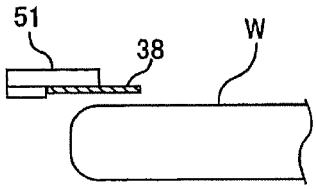
FIG. 3A, FIG. 3B, FIG. 3C, and FIG. 3D are diagrams illustrating an embodiment of a polishing method.
Figure 3B:
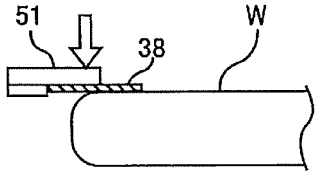
Figure 3C:
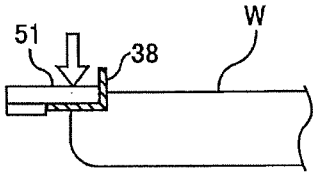

FIGS. 3A through 3D are diagrams illustrating an embodiment of a polishing method. As shown in FIG. 3A, the polishing tape 38 and the pressing pad 51 are positioned such that a portion of the polishing tape 38 (i.e., a portion extending in the longitudinal direction of the polishing tape 38) projects from the pressing pad 51 inwardly in the radial direction of the wafer W. In this state, as shown in FIG. 3B, the pressing pad 51 is lowered by the vertically moving mechanism 59 to press the polishing surface of the polishing tape 38 against the edge portion of the rotating wafer W. The pressing pad 51 is further lowered, so that the polishing tape 38 polishes the edge portion of the wafer W until a vertical surface and a horizontal surface are formed on the edge portion of the wafer W as shown in FIG. 3C (first polishing process). The pressing pad 51 has a wafer pressing surface which is a horizontal surface parallel to the wafer surface. This horizontal pressing surface presses the polishing tape 38 against the edge portion of the wafer W to thereby form the vertical surface and the horizontal surface on the edge portion of the wafer W. The polishing surface of the polishing tape 38 when contacting the wafer W is parallel to the surface of the wafer W. During polishing, an inner edge of the pressing pad 51 is pressed against the edge portion of the wafer W through the polishing tape 38.

Figure 3D:
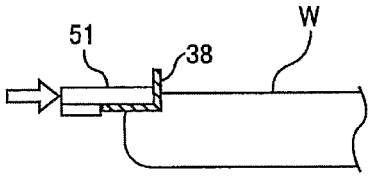

As the pressing pad 51 moves downward, the portion (i.e., the projecting portion) of the polishing tape 38, projecting from the pressing pad 51, is bent upwardly along the pressing pad 51. In this state, as shown in FIG. 3D, the pressing pad 51 is pressed inwardly in the radial direction of the wafer W by the radially moving mechanism 45 to thereby polish the vertical surface of the wafer W with the bent portion of the polishing tape 38 (second polishing process). Because the polishing tape 38 is bent in this state, the polishing surface of the bent portion contacts the vertical surface on the wafer edge portion. Therefore, the vertical surface of the wafer W is polished by the polishing surface of the polishing tape 38.

In this manner, the vertical surface formed on the edge portion of the wafer W in the first polishing process is polished by the polishing surface of the polishing tape 38 in the second polishing process. Therefore, the vertical surface can be smoothened. A rough polishing tape for performing rough polishing may be used in the first polishing process, while a fine polishing tape for performing finish polishing may be used in the second polishing process. As shown in FIG. 3C, the bent portion of the polishing tape 38 is preferably longer than a depth of the polished portion formed on the edge portion of the wafer W (i.e. a height of the vertical surface).

When polishing is performed by merely pressing the polishing tape 38 against the edge portion of the wafer W, a polishing mark may be formed on the edge portion of the wafer W. To avoid this, at least one of the first polishing process and the second polishing process may be performed while moving the polishing tape 38 in its longitudinal direction. By polishing the edge portion of the wafer W while advancing the polishing tape 38 in this manner, a polishing mark once formed on the wafer W can be removed. The movement direction of the polishing tape 38 may be opposite to the movement direction of the edge portion of the rotating wafer W in order to increase a polishing rate of the wafer W and to create a geometrically correct shape. In order to remove a polishing mark more effectively, the polishing tape 38 may be moved in the radial direction of the wafer W while the polishing tape 38 is pressing the edge portion of the wafer W.

Figure 4:
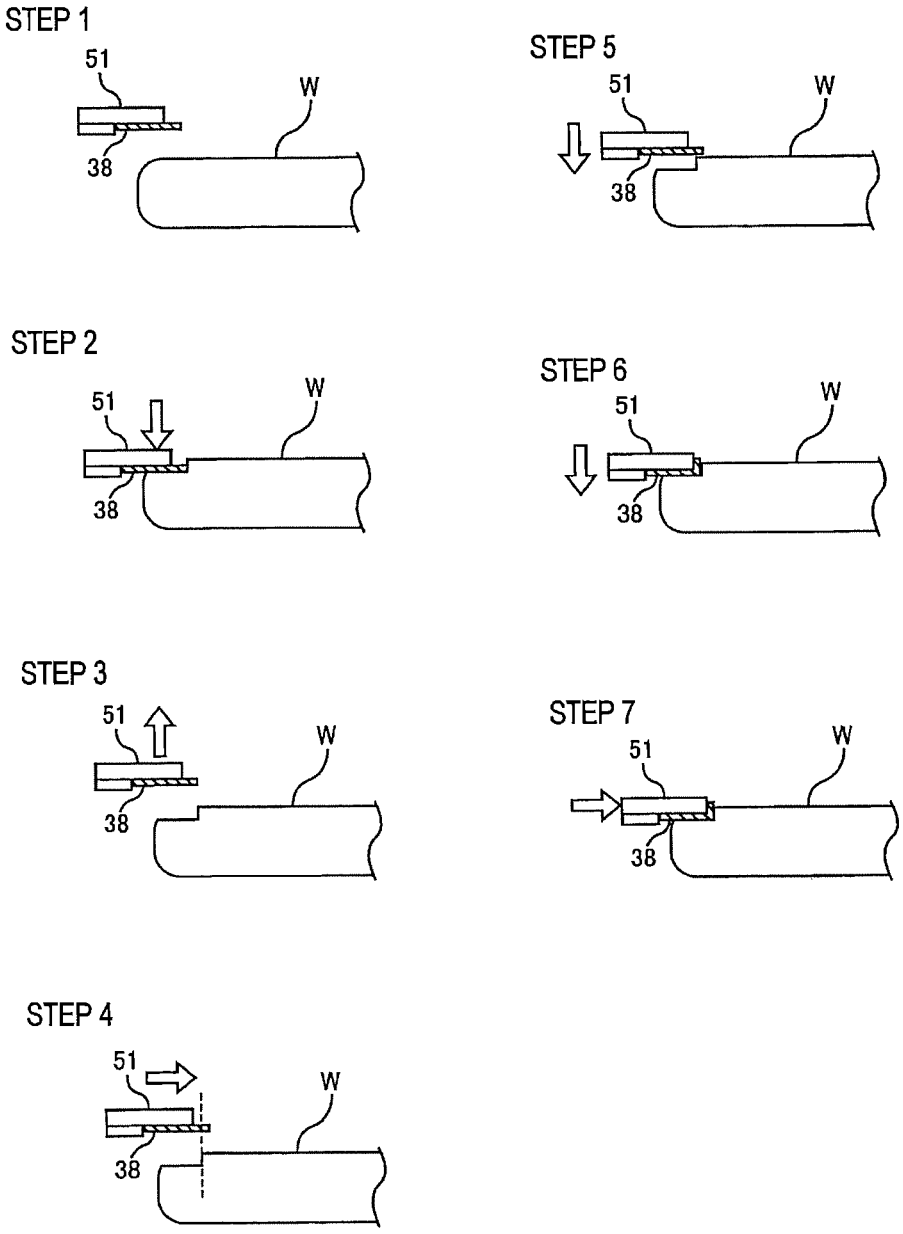
FIG. 4 is a diagram illustrating another embodiment of a polishing method.

FIG. 4 is a diagram illustrating another embodiment of a polishing method. With reference to the construction and the operation of this embodiment which are the same as those of the above-described embodiment, a duplicate description thereof will be omitted. In step 1, positioning of the polishing tape 38 and the pressing pad 51 is performed such that a portion of the polishing tape 38 (a portion extending in the longitudinal direction of the polishing tape 38) slightly projects from the pressing pad 51 inwardly in the radial direction of the wafer W. This positioning is performed by the radially moving mechanism 45 and the tape moving mechanism 46. The polishing tape 38 lies above the edge portion of the wafer W. The reason for partly projecting the polishing tape 38 from the pressing pad 51 is to avoid contact of the pressing pad 51 with the edge portion of the wafer W during polishing of the wafer W.

In step 2, the pressing pad 51 is lowered by the vertically moving mechanism 59 to press the polishing surface of the polishing tape 38 against the edge portion of the rotating wafer W, thereby forming the vertical surface and the horizontal surface on the edge portion of the wafer W (the first polishing process). During polishing, the inner edge of the pressing pad 51 is pressed against the edge portion of the wafer W through the polishing tape 38. In step 3, the pressing pad 51 and the polishing tape 38 are elevated by the vertically moving mechanism 59, so that the polishing tape 38 is separated from the wafer W.

In step 4, with the pressing pad 51 and the polishing tape 38 separated from the wafer W, they are moved inwardly in the radial direction of the wafer W by a predetermined distance. More specifically, the pressing pad 51 and the polishing tape 38 are moved inwardly in the radial direction of the wafer W until the inner edge of the polishing tape 38 is located radially inwardly of the vertical surface of the wafer W and the inner edge of the pressing pad 51 is located radially outwardly of the vertical surface of the wafer W. The movement of the pressing pad 51 and the polishing tape 38 in this step 4 is performed by the radially moving mechanism 45 and the tape moving mechanism 46.

In step 5, the pressing pad 51 and the polishing tape 38 are lowered by the vertically moving mechanism 59. The width of the projecting portion of the polishing tape 38 in this step 5 may be equal to or larger than the width of the projecting portion in step 1. In step 6, the portion (i.e., the projecting portion) of the polishing tape 38 is pressed against an angular portion formed by the vertical surface and the front surface (i.e., the upper surface) of the wafer W, so that the portion of the polishing tape 38 is bent upwardly. This angular portion has been formed on the edge portion of the wafer W in the first polishing process. In step 7, the pressing pad 51 is pressed inwardly in the radial direction of the wafer W by the radially moving mechanism 45 to thereby polish the vertical surface on the edge portion of the wafer W with the bent portion of the polishing tape 38 (the second polishing process). The polishing surface of the bent portion of the polishing tape 38 contacts the vertical surface on the wafer edge portion. Therefore, the vertical surface of the wafer W is polished by the polishing surface of the polishing tape 38.

Also in this embodiment, the vertical surface formed on the edge portion of the wafer W in the first polishing process is polished by the polishing tape 38 in the second polishing process. Therefore, the vertical surface can be smoothened. At least one of the first polishing process and the second polishing process may be performed while moving the polishing tape 38 in its longitudinal direction. In this case, the movement direction of the polishing tape 38 may be opposite to the movement direction of the edge portion of the rotating wafer W in order to increase the polishing rate of the wafer W. In order to remove the polishing mark, the polishing tape 38 may be moved in the radial direction of the wafer W while the polishing tape 38 is pressing the edge portion of the wafer W.

Figure 5:
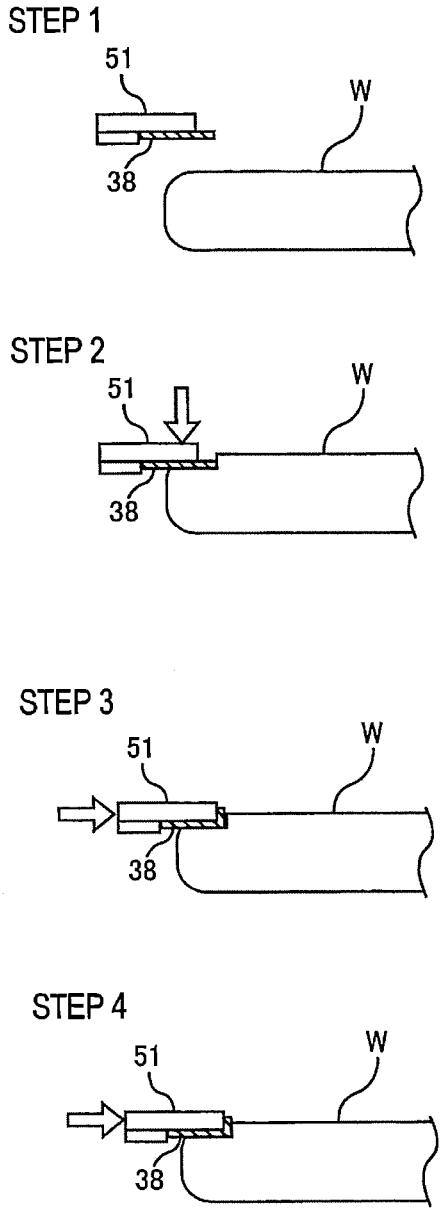
FIG. 5 is a diagram illustrating another example of the polishing method illustrated in FIG. 4.

In the steps 3 and 4 illustrated in FIG. 4, the polishing tape 38 is once separated from the wafer W. Alternatively, it is also possible to bend the projecting portion of the polishing tape 38 while keeping the polishing tape 38 in contact with the edge portion of the wafer W, as will be described with reference to FIG. 5. FIG. 5 is a diagram illustrating another example of the polishing method illustrated in FIG. 4. The first polishing process, constituted by step 1 and step 2, of this example is the same as the above-described steps 1 and 2 illustrated in FIG. 4. After the first polishing process, in step 3, with the polishing tape 38 in contact with the wafer W, the pressing pad 51 and the polishing tape 38 are moved inwardly in the radial direction of the wafer W to press the projecting portion of the polishing tape 38 against the vertical surface which has been formed in the first polishing process on the edge portion of the wafer W, thereby bending the portion (i.e., the projecting portion) of the polishing tape 38 upwardly. In step 4, the pressing pad 51 is further pressed inwardly in the radial direction of the wafer W by the radially moving mechanism 45 to allow the bent portion of the polishing tape 38 to polish the vertical surface (the second polishing process).

Figure 6:
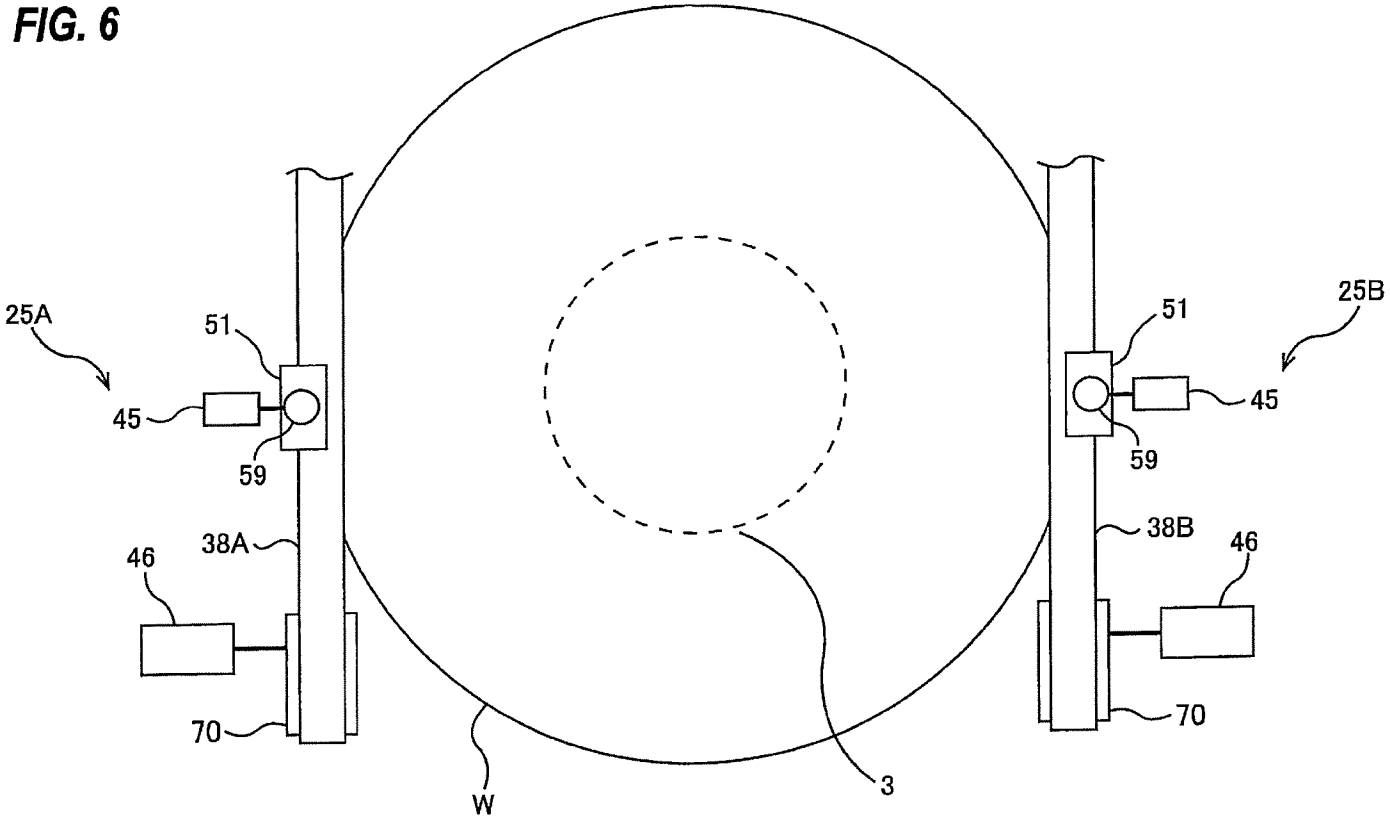
FIG. 6 is a schematic view showing a polishing apparatus including a first polishing unit and a second polishing unit.

The first polishing process (the steps 1 to 3) and the second polishing process (the steps 4 to 7), illustrated in FIG. 4, may be performed using different types of polishing tapes. In such a case, as shown in FIG. 6, a polishing apparatus including a first polishing unit 25A and a second polishing unit 25B, having the same construction, is used. The polishing units 25A, 25B are disposed symmetrically with respect to the center of the wafer W held by the wafer holder 3. The polishing units 25A, 25B have the same construction as the polishing unit 25 shown in FIG. 1, and therefore a duplicate description thereof is omitted.

Figure 7:
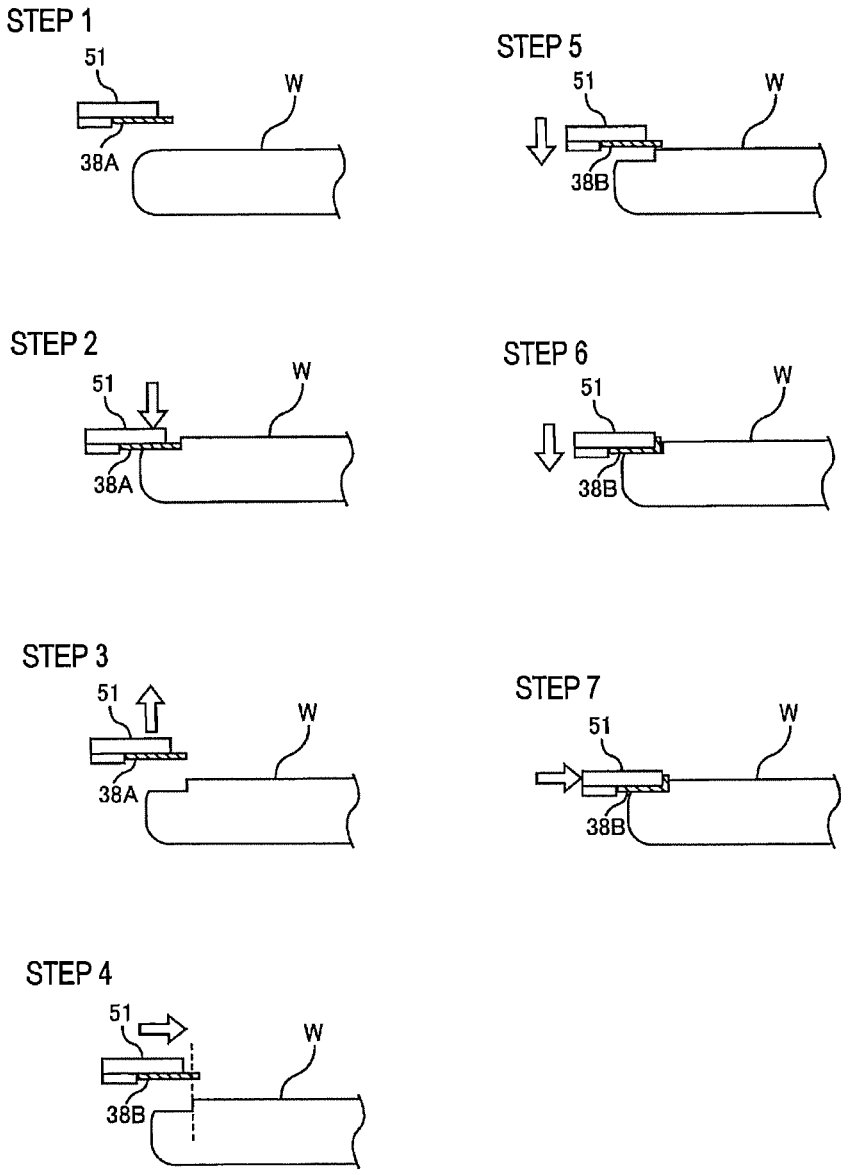
FIG. 7 is a diagram illustrating a method of polishing a wafer using the polishing apparatus shown in FIG. 6.

The first polishing unit 25A has a rough first polishing tape 38A, while the second polishing unit 25B has a fine second polishing tape 38B. FIG. 7 is a diagram illustrating a method of polishing a wafer using the polishing apparatus shown in FIG. 6.

In step 1, the first polishing tape 38A and the pressing pad 51 are positioned such that a portion of the first polishing tape 38A slightly projects from the pressing pad 51 of the first polishing unit 25A inwardly in the radial direction of a wafer W. In step 2, the pressing pad 51 is lowered by the vertically moving mechanism 59 of the first polishing unit 25A to press the polishing surface of the first polishing tape 38A against an edge portion of the rotating wafer W, thereby forming a vertical surface and a horizontal surface on the edge portion of the wafer W (first polishing process). During polishing, an inner edge of the pressing pad 51 is pressed against the edge portion of the wafer W through the first polishing tape 38A. In step 3, the pressing pad 51 and the first polishing tape 38A of the first polishing unit 25A are elevated by the vertically moving mechanism 59, so that the first polishing tape 38A is separated from the wafer W.

In step 4, the second polishing tape 38B and the pressing pad 51 are positioned such that a portion of the second polishing tape 38B projects from the pressing pad 51 of the second polishing unit 25B inwardly in the radial direction of the wafer W. The inner edge of the second polishing tape 38B is located radially inwardly of the vertical surface of the wafer W, and the inner edge of the pressing pad 51 of the second polishing unit 25B is located radially outwardly of the vertical surface of the wafer W. A horizontal distance between the inner edge of the pressing pad 51 of the second polishing unit 25B and the vertical surface of the wafer W is larger than a thickness of the second polishing tape 38B.

In step 5, the pressing pad 51 and the second polishing tape 38B are lowered by the vertically moving mechanism 59 of the second polishing unit 25B. In step 6, the projecting portion of the second polishing tape 38B is pressed against the angular portion formed by the vertical surface and the front surface (i.e., the upper surface) of the wafer W, so that the portion of the polishing tape 38B is bent upwardly. The angular portion has been formed on the edge portion of the wafer W in the first polishing process. In step 7, the pressing pad 51 is pressed inward in the radial direction of the wafer W by the radially moving mechanism 45 of the second polishing unit 25B to thereby polish the vertical surface on the edge portion of the wafer W with the bent portion of the second polishing tape 38B (second polishing process). The polishing surface of the bent portion of the second polishing tape 38B contacts the vertical surface on the wafer edge portion. Therefore, the vertical surface of the wafer W can be polished by the polishing surface of the second polishing tape 38B. At least one of the first polishing process and the second polishing process may be performed while moving the polishing tape in its longitudinal direction. In this case, the movement direction of the polishing tape may be opposite to the movement direction of the edge portion of the rotating wafer W in order to increase the polishing rate of the wafer W. In order to remove the polishing mark, the polishing tape 38 may be moved in the radial direction of the wafer W while the polishing tape 38 is pressing the edge portion of the wafer W.

According to this embodiment, a smooth vertical surface can be formed on the edge portion of a wafer W by the use of the second polishing tape with fine abrasive particles. Furthermore, multi-stage polishing of a wafer W can be performed with use of difference types of polishing tapes while keeping the wafer W held on the wafer holder 3. This embodiment has an advantage that there is no need to transport the wafer W between the first polishing process and the second polishing process. This can avoid a centering error of a wafer between the first polishing process and the second polishing process. It is also possible to use three or more polishing units.

Figure 8A:
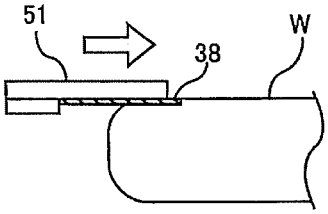
FIG. 8A, FIG. 8B, FIG. 8C, FIG. 8D, and FIG. 8E are views each illustrating still another embodiment of the polishing method.
Figure 8B:
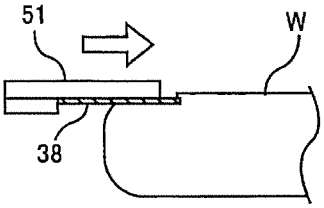
Figure 8C:
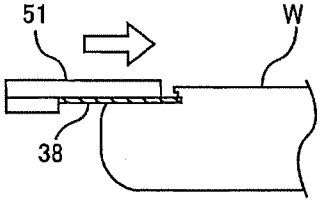
Figure 8D:
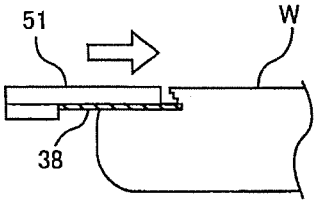
Figure 8E:
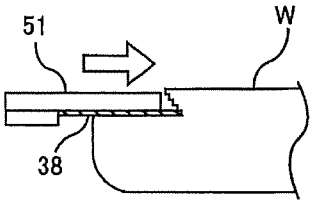

A polishing method according to yet another embodiment will now be described. FIGS. 8A through 8E are diagrams illustrating the polishing method according to yet another embodiment. In this embodiment, a polishing tape polishes an edge portion of a wafer W multiple times while the polishing tape slides on the edge portion in the radial direction of the wafer W. More specifically, as shown in FIG. 8A, with a portion of a polishing tape 38 projecting from the pressing pad 51 inwardly in the radial direction of the wafer W, the polishing tape 38 is pressed by the pressing pad 51 against an edge portion of the wafer W. Further, while keeping the polishing tape 38 in contact with the edge portion, the polishing tape 38 and the pressing pad 51 are moved inwardly in the radial direction of the wafer W. As a result, the polishing tape 38 slides on the edge portion and polishes the edge portion until it reaches a predetermined stop position.

Figure 56:
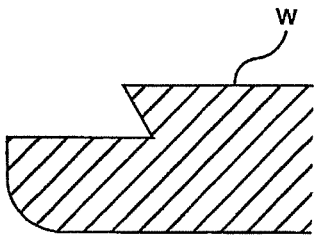
FIG. 56 is a cross-sectional view showing a reverse tapered surface formed on an edge portion of a wafer.
Figure 57:
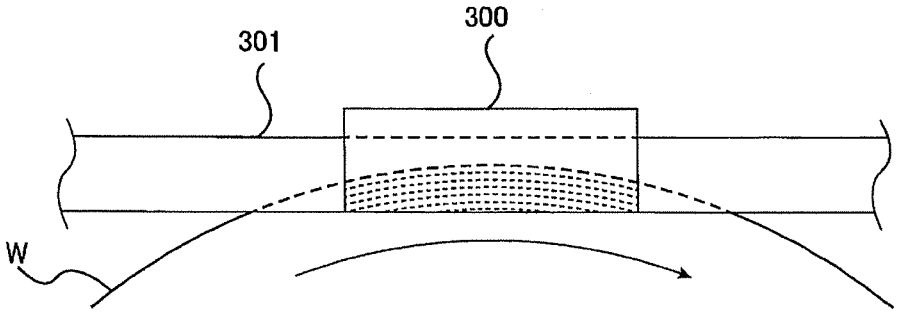
FIG. 57 is a plan view of a pressing pad and a polishing tape shown in FIG. 54.

As shown in FIGS. 8B through 8E, the slide-polishing process of sliding the polishing tape 38 on the edge portion of the wafer W is repeated in the same way. Each time the slide-polishing process is performed, the stop position of the polishing tape 38 is slightly shifted (by a predetermined distance) inwardly in the radial direction of the wafer W. By thus repeating the slide-polishing process while slightly shifting the stop position of the polishing tape 38 in each process, a reverse tapered surface as shown in FIG. 56 can be formed on the edge portion of the wafer W. After the polishing tape 38 has reached the predetermined stop position and before the next slide-polishing process is started, the pressing pad 51 and the polishing tape 38 may be once separated from the wafer W and moved to a start position for the next slide-polishing process, or may slide outwardly in the radial direction of the wafer W to a start position for the next slide-polishing process. Also in this embodiment, the slide-polishing process may be performed while moving the polishing tape 38 in its longitudinal direction. In this case, the movement direction of the polishing tape 38 may be opposite to the movement direction of the edge portion of the rotating wafer W in order to increase the polishing rate of the wafer W.

Figure 9A:
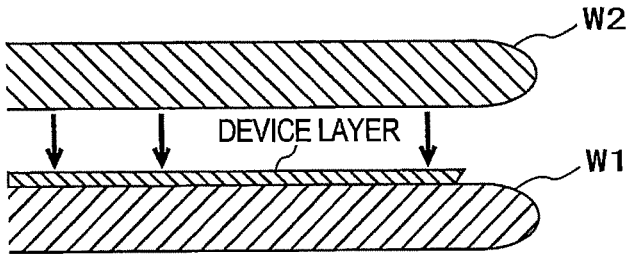
FIG. 9A, FIG. 9B, FIG. 9C, and FIG. 9D are views for illustrating a fabrication process of an SOI substrate.
Figure 9B:
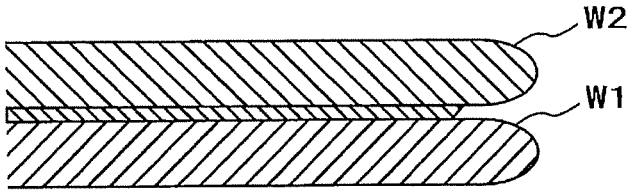
Figure 9C:
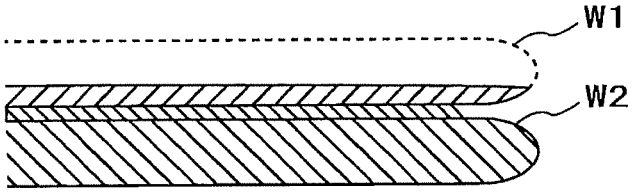
Figure 9D:
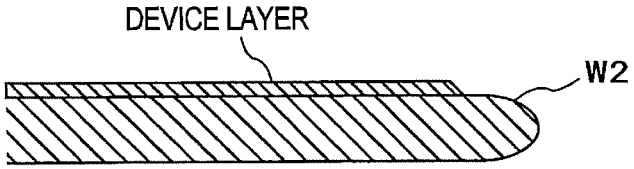

The reverse tapered surface formed on the edge portion of the wafer W by the slide-polishing process illustrated in FIGS. 8A through 8E is advantageous in fabrication of an SOI (Silicon on Insulator) substrate. The SOI substrate is fabricated by bonding a device wafer and a silicon wafer together. More specifically, as shown in FIGS. 9A and 9B, a device wafer W1 and a silicon wafer W2 are bonded together. After turning over the laminated wafers, the back surface of the device wafer W1 is ground by a grinder as shown in FIG. 9C, so that an SOI substrate as shown in FIG. 9D is obtained. As can be seen from FIG. 9D, since an end surface of a device layer on the silicon wafer W2 is the tapered surface, the device layer is unlikely to be chipped.

Figure 10:
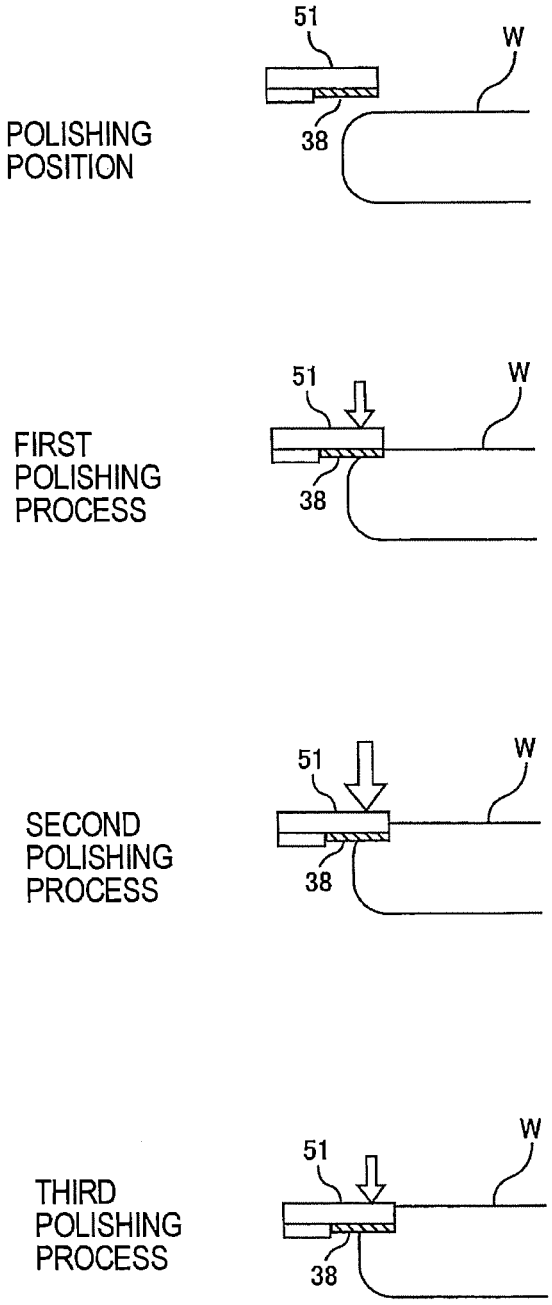
FIG. 10 is a diagram illustrating yet another embodiment of a polishing method.

FIG. 10 is a diagram illustrating yet another embodiment of a polishing method. With reference to the construction and the operation of this embodiment which are the same as those of the above-described embodiments, a duplicate description thereof will be omitted. This embodiment is the same as the above-described embodiments in that the polishing tape 38 is disposed along the tangential direction of a wafer W, but differs from the above-described embodiments in that the pressing pad 51, with its edge coinciding with the edge of the polishing tape 38, presses the polishing tape 38 against an edge portion of the wafer W to polish it.

The polishing method of this embodiment includes a first polishing process as an initial-stage polishing process, a second polishing process as a high-removal-rate polishing process, and a third polishing process as a final-stage polishing process. The first polishing process is a process of pressing the edge of the polishing tape 38 against the edge portion of the wafer W by the pressing pad 51 at a first pressure while rotating the wafer W. The second polishing process is a process of pressing the edge of the polishing tape 38 against the edge portion of the wafer W by the pressing pad 51 at a second pressure, which is higher than the first pressure, while rotating the wafer W. The third polishing process is a process of pressing the edge of the polishing tape 38 against the edge portion of the wafer W by the pressing pad 51 at a third pressure, which is lower than the second pressure, while rotating the wafer W. In the first polishing process, the second polishing process, and the third polishing process, the edge of the polishing tape 38 is pressed by the edge of the pressing pad 51 against the edge portion of the wafer W, whereby the vertical surface and the horizontal surface are formed on the edge portion of the wafer W.

The pressure of the polishing tape 38 on the wafer W and a rotational speed of the wafer W may be varied in the first polishing process, the second polishing process, and the third polishing process. For example, the wafer W may be rotated at a first rotational speed in the first polishing process, and may be rotated at a second rotational speed, which is higher than the first rotational speed, in the second polishing process. The rotational speed of the wafer W in the third polishing process may be equal to the first rotational speed or the second rotational speed. The third pressure in the third polishing process may be equal to the first pressure in the first polishing process, or lower than the first pressure, or higher than the first pressure.

In the first polishing process, the wafer W is slowly polished with the low pressure. This step can therefore form a right-angled angular portion on the edge portion of the wafer W without causing a defect on the angular portion. In the second polishing process, the wafer W is polished with the high pressure. This step can therefore shorten the overall polishing time. In the third polishing process, the wafer W is polished with the low pressure. This step can therefore improve surface roughness of the edge portion of the wafer W. An additional polishing process(s) may be performed after the third polishing process.

In this embodiment, a flat portion, including the edge, of the polishing tape 38 is pressed against the edge portion of the wafer W, with the edge of the polishing tape 38 coinciding with the edge of the pressing pad 51. The edge of the polishing tape 38 is a right-angled corner, and the edge of the pressing pad 51 presses this right-angled corner downwardly against a peripheral portion of the wafer W. The polished wafer W can therefore have a right-angled cross-section as shown in FIG. 10. The first polishing process, the second polishing process, and the third polishing process may be performed while moving the polishing tape 38 in its longitudinal direction. In this case, the movement direction of the polishing tape 38 may be opposite to the movement direction of the edge portion of the rotating wafer W in order to increase the polishing rate of the wafer W.

Figure 11:
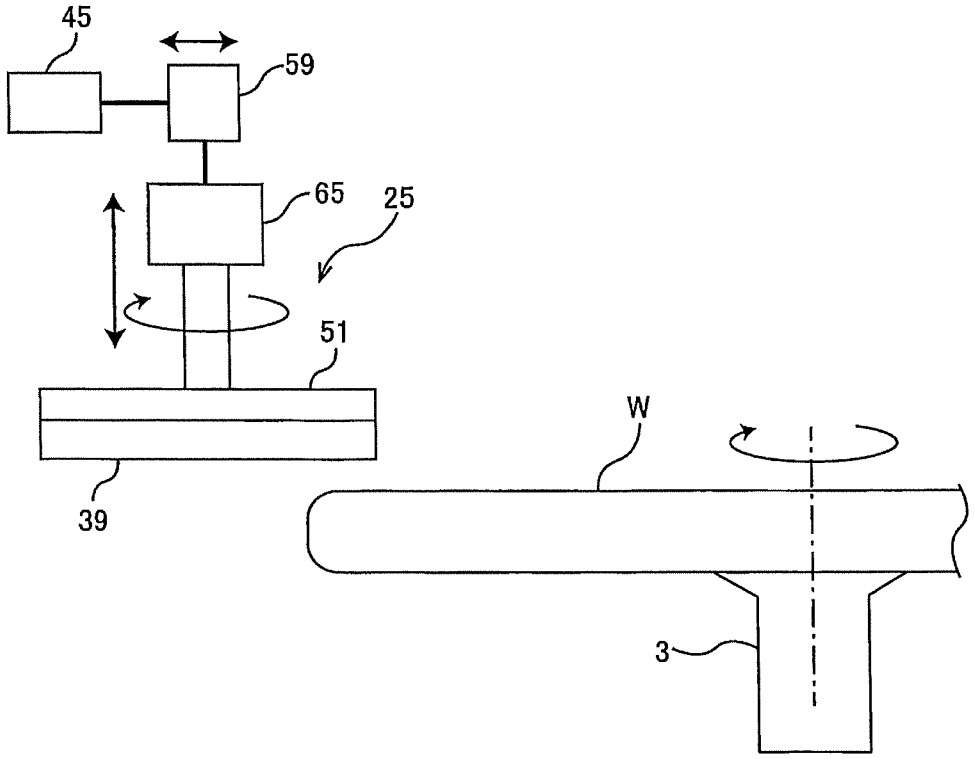
FIG. 11 is a schematic view of a polishing apparatus for carrying out yet another embodiment of a polishing method.

FIG. 11 is a schematic view of a polishing apparatus for carrying out yet another embodiment of a polishing method. Instead of a polishing tape, a fixed abrasive (or a grindstone) 39 is used in this embodiment as the polishing tool for polishing a peripheral portion of a wafer W. The fixed abrasive 39 has a disk shape and is secured to a lower surface of a circular pressing member 51. This pressing member 51 is coupled to a motor 65, so that the fixed abrasive 39 is rotated together with the pressing member 51 by the motor 65. The motor 65 is coupled to vertically moving mechanism 59 for moving the pressing member 51 and the fixed abrasive 39 in a direction perpendicular to the wafer surface, and the vertically moving mechanism 59 is coupled to radially moving mechanism 45 for moving the pressing member 51 and the fixed abrasive 39 in the radial direction of the wafer W.

Figure 12A:
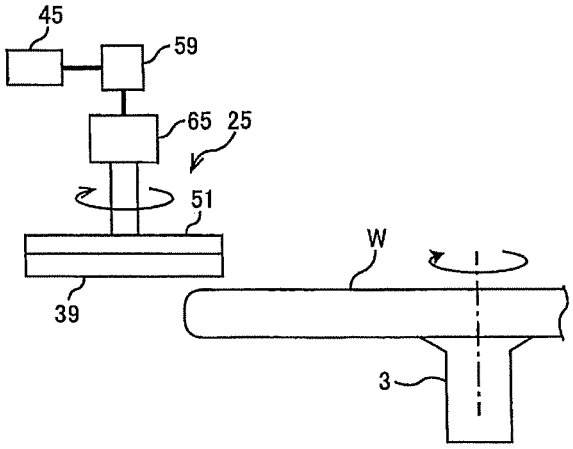
FIG. 12A, FIG. 12B, and FIG. 12C are diagrams illustrating a polishing method using the polishing apparatus shown in FIG. 11.
Figure 12B:
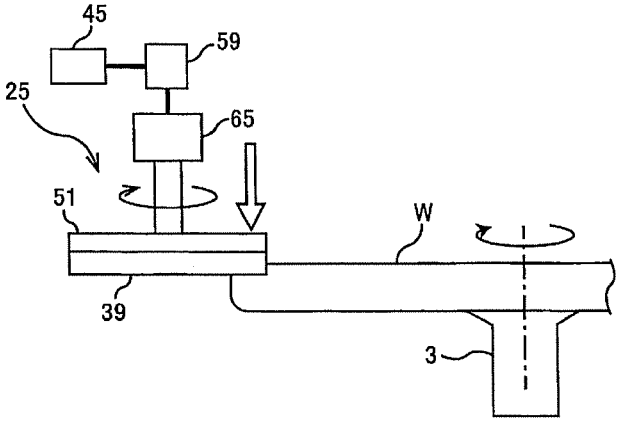
Figure 12C:
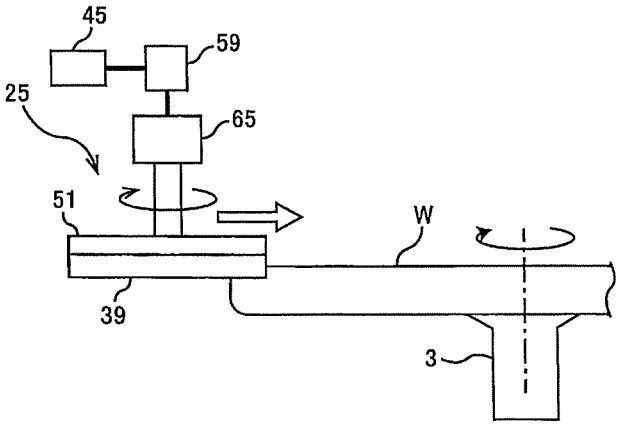

FIGS. 12A through 12C are diagrams illustrating a polishing method using the polishing apparatus shown in FIG. 11. As shown in FIG. 12A, while rotating the wafer W, the fixed abrasive 39 and the pressing member 51 are rotated about their own axis by the motor 65. In this state, as shown in FIG. 12B, the rotating pressing member 51 and the rotating fixed abrasive 39 are lowered by the vertically moving mechanism 59 to press a lower surface of the fixed abrasive 39 against the edge portion of the rotating wafer W, thereby forming a vertical surface and a horizontal surface on the edge portion of the wafer W (first polishing process). Thereafter, as shown in FIG. 12C, the rotating pressing member 51 and the rotating fixed abrasive 39 are pressed inwardly in the radial direction of the wafer W by the radially moving mechanism 45, so that the vertical surface on the wafer edge portion is polished by a circumferential surface of the fixed abrasive 39 (second polishing process). In this manner, it is possible to use the fixed abrasive 39, such as a grindstone, as a polishing tool.

Figure 13:
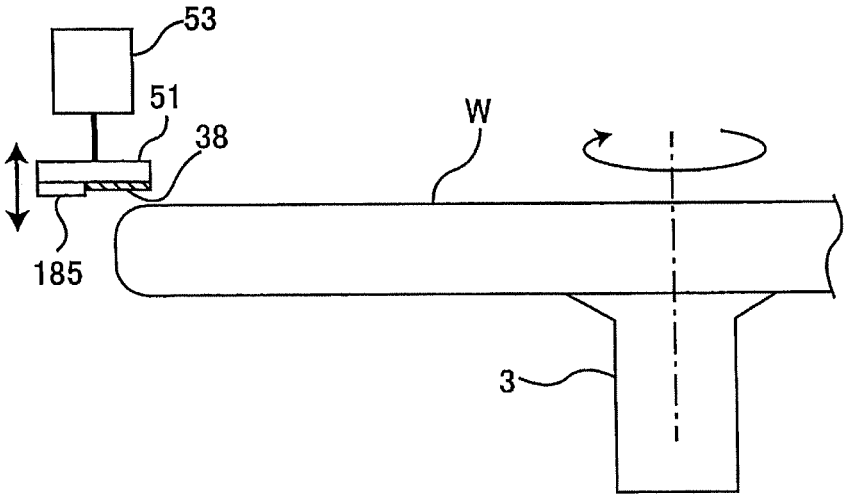
FIG. 13 is a schematic view illustrating a polishing apparatus for carrying out an embodiment of a polishing method.
Figure 14:
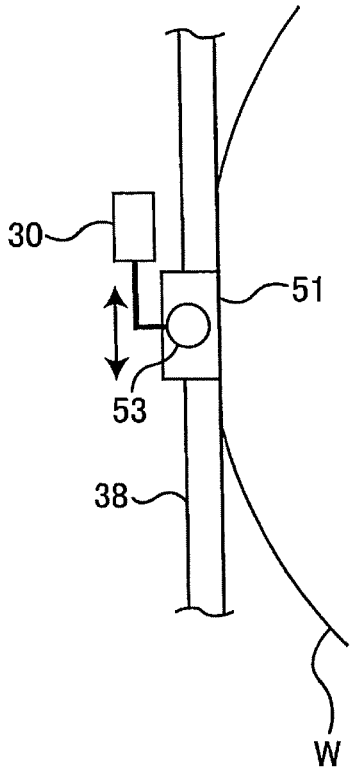
FIG. 14 is a plan view of the polishing apparatus shown in FIG. 13.

FIG. 13 is a schematic view illustrating a polishing apparatus for carrying out yet another embodiment of a polishing method, and FIG. 14 is a plan view of the polishing apparatus shown in FIG. 13. The polishing apparatus includes wafer holder 3 for holding and rotating a wafer W as a substrate, pressing pad 51 for pressing a polishing tape 38 against an edge portion of the wafer W, pressing device 53 for pressing the pressing pad 51 toward the wafer W, and a tangentially moving mechanism 30 for moving the pressing pad 51 and the pressing device 53 in a tangential direction of the wafer W. A pneumatic cylinder or a combination of a servo motor and a ball screw can be used as the pressing device 53. A combination of a servo motor and a ball screw can be used as the tangentially moving mechanism 30.

The polishing tape 38 is disposed such that its polishing surface lies parallel to the surface of the wafer W and faces the edge portion of the wafer W. One surface (a lower surface) of the polishing tape 38 constitutes the polishing surface having abrasive particles fixed thereon. The polishing tape 38 is a long polishing tool, and is disposed along the tangential direction of the wafer W. The pressing pad 51 is a pressing tool for pressing the polishing tape 38 against the edge portion of the wafer W, and is disposed above the edge portion of the wafer W. A tape stopper 185 for restricting a horizontal movement of the polishing tape 38 is fixed to the bottom of the pressing pad 51. The tape stopper 185 may be omitted.

Figure 15:
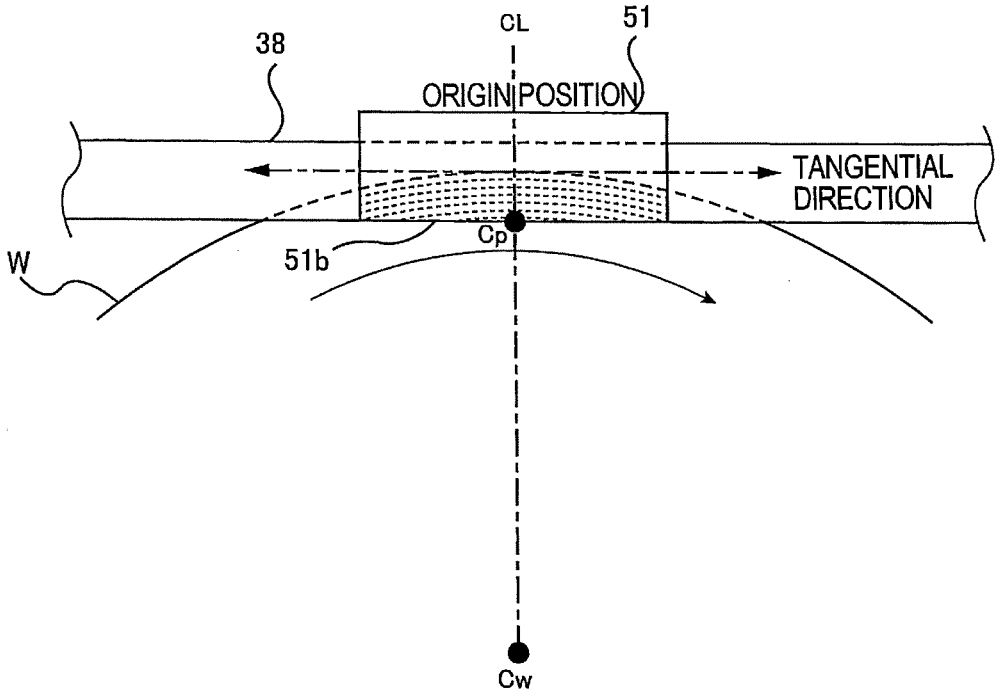
FIG. 15 is a diagram illustrating an embodiment of a polishing method.

FIG. 15 is a diagram illustrating an embodiment of a polishing method of the present invention. An origin position of the pressing pad 51 is preset on a center line CL extending radially from a center Cw of the wafer W. The origin position is a reference position of the pressing pad 51 when polishing the edge portion of the wafer W. A midpoint Cp of an inner edge 51*b* of the pressing pad 51 in the origin position lies on the center line CL. This inner edge 51*b* of the pressing pad 51 is an inner edge of its pressing surface that presses the polishing tape 38 against the edge portion of the wafer W, i.e., an edge at an inner side with respect to the radial direction of the wafer W.

Polishing of the wafer W is carried out in the following manner. First, the wafer W is rotated by the wafer holder 3. The polishing tape 38, with its edge coinciding with the edge of the pressing pad 51, is pressed against the edge portion of the rotating wafer W by the pressing pad 51 to polish the edge portion of the wafer W. A portion of the polishing tape 38 may project from the edge of the pressing pad 51 inwardly in the radial direction of the wafer W when the polishing tape 38 is pressed against the edge portion of the rotating wafer W. The edge of the polishing tape 38 is a right-angled corner, and the edge of the pressing pad 51 presses this right-angled corner downwardly against the edge portion of the wafer W. The polishing surface of the polishing tape 38 when contacting the wafer W is parallel to the surface of the wafer W. During polishing, the inner edge of the pressing pad 51 is pressed against the edge portion of the wafer W through the polishing tape 38. A wafer pressing surface (i.e., a substrate pressing surface) of the pressing pad 51 is a horizontal surface parallel to the wafer surface. The pressing pad 51 has a wafer pressing surface (i.e., a substrate pressing surface) which is a horizontal surface parallel to the wafer surface. This horizontal pressing surface presses the polishing tape 38 against the edge portion of the wafer W to thereby form the vertical surface and the horizontal surface on the edge portion of the wafer W.

Figure 16:
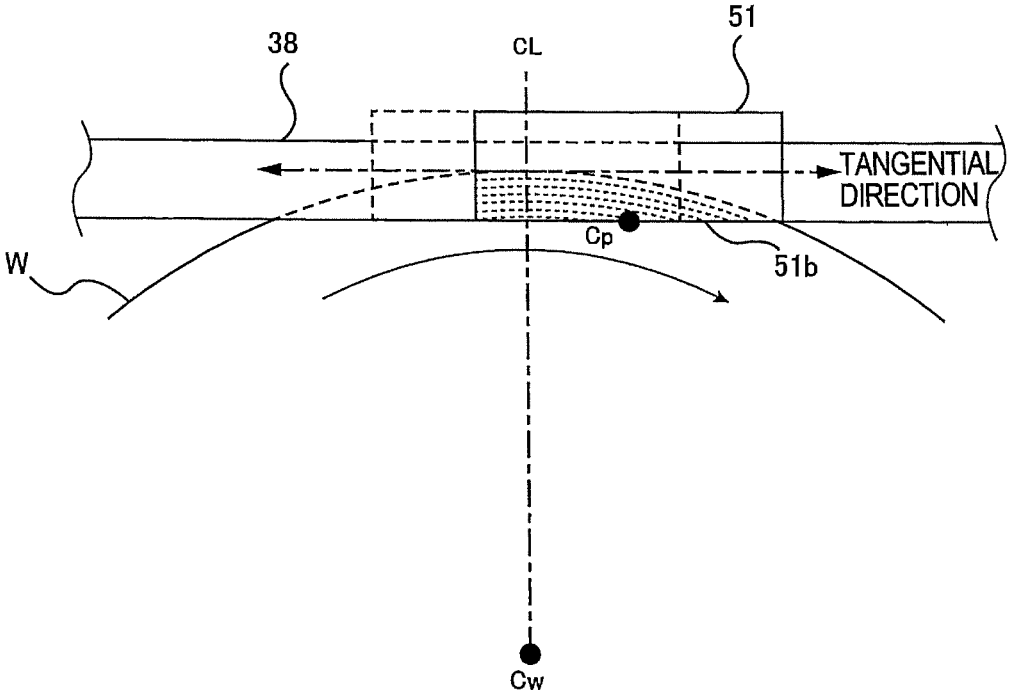
FIG. 16 is a diagram showing a state in which a pressing pad is displaced in a tangential direction by a predetermined distance from an origin position.
Figure 58:
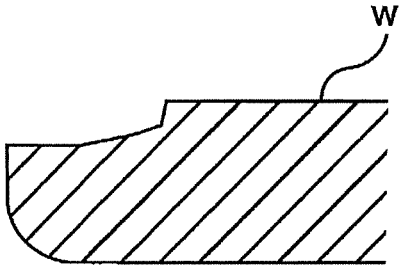
FIG. 58 is a cross-sectional view showing an edge portion of a polished wafer.

However, as described previously, an area of contact between the polishing tape 38 and the wafer W differs depending on the radial position in the wafer edge portion. Consequently, an inner region in the horizontal surface of the wafer edge portion may be inclined as shown in FIG. 58. In view of this, in this embodiment the pressing pad 51 is displaced by a predetermined distance from the origin position in the tangential direction which is perpendicular to the center line CL, as shown in FIG. 16, and the polishing tape 38 is pressed against the wafer W by the pressing pad 51 in the displaced position. As can be seen in FIG. 16, by displacing the position of the pressing pad 51 in the tangential direction of the wafer W, the area of contact (i.e., a contact length) between the polishing tape 38 and an outer region in the horizontal surface of the wafer edge portion can be reduced without changing the area of contact between the polishing tape 38 and the inner region in the horizontal surface. The polishing tape 38 can therefore form the flat horizontal surface as shown in FIG. 15B on the edge portion of the wafer W. The predetermined distance by which the pressing pad 51 is displaced is preferably less than half the length of the pressing pad 51 along the tangential direction. Such displacement distance of the pressing pad 51 hardly affects the formation of the innermost vertical surface of the edge portion of the wafer W. The profile of the horizontal surface can be modified by changing the distance by which the pressing pad 51 is displaced from the origin position in the tangential direction perpendicular to the center line CL. For example, a horizontal surface inclined at a desired angle can be formed by adjusting the distance by which the pressing pad 51 is displaced from the origin position.

Figure 17:
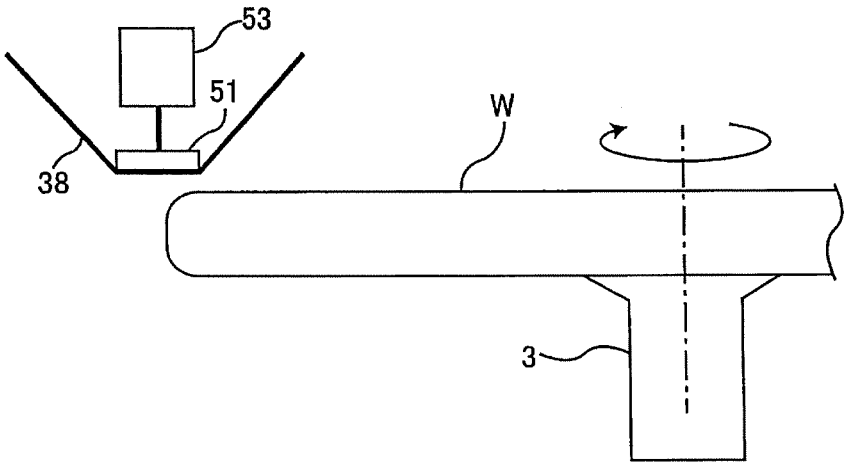
FIG. 17 is a schematic view illustrating a polishing apparatus for carrying out yet another embodiment of a polishing method.
Figure 18:
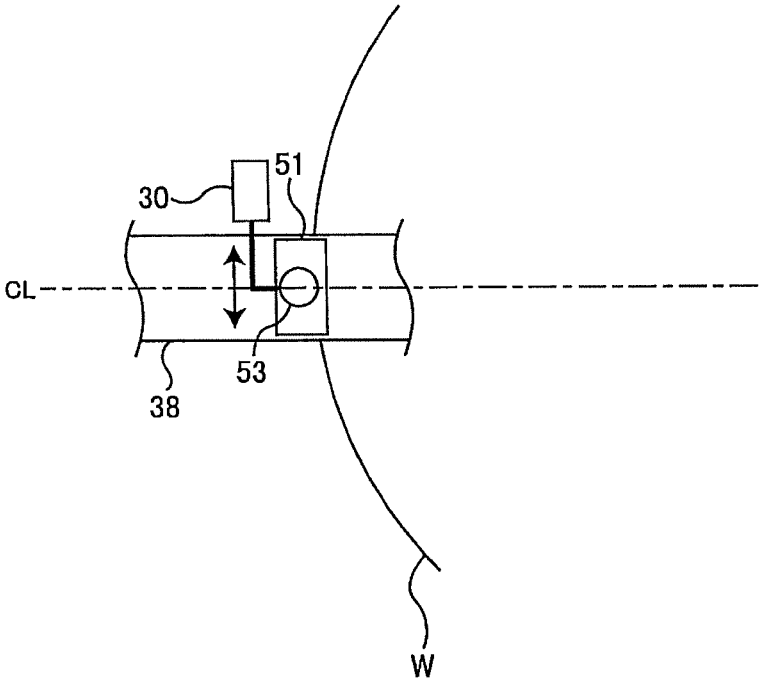
FIG. 18 is a plan view of the polishing apparatus shown in FIG. 17.

The present invention can also be applied to a polishing method which uses a polishing tape 38 disposed in the radial direction of a wafer W. FIG. 17 is a schematic view illustrating a polishing apparatus for carrying out yet another embodiment of a polishing method of the present invention, and FIG. 18 is a plan view of the polishing apparatus shown in FIG. 17. The polishing apparatus shown in FIGS. 17 and 18 differs from the polishing apparatus shown in FIGS. 13 and 14 in that the polishing tape 38 is disposed such that the polishing tape 38 extends along the center line CL (i.e. the polishing tape 38 extends in the radial direction of the wafer W) when viewed from above the wafer W. The other constructions of the polishing apparatus shown in FIGS. 17 and 18 are the same as those of the polishing apparatus shown in FIGS. 13 and 14.

Polishing of the wafer W is carried out in the following manner. First, the wafer W is rotated by the wafer holder 3. The polishing tape 38 is pressed against the edge portion of the rotating wafer W by the pressing pad 51 to polish the edge portion of the wafer W. During polishing, the inner edge of the pressing pad 51 is pressed against the edge portion of the wafer W through the polishing tape 38.

Figure 19:
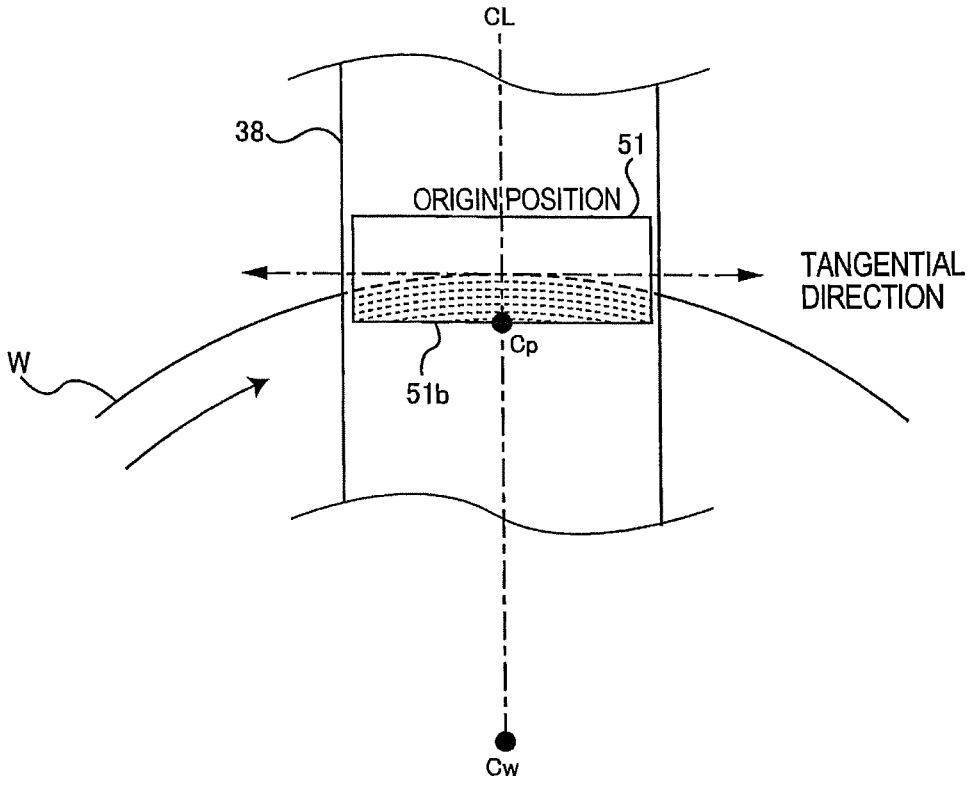
FIG. 19 is a diagram illustrating a polishing method as performed by the polishing apparatus shown in FIGS. 17 and 18.

FIG. 19 is a diagram illustrating a polishing method as performed by the polishing apparatus shown in FIGS. 17 and 18. As with the above-described embodiment, the origin position of the pressing pad 51 is preset on the center line CL extending radially from the center Cw of the wafer W. The midpoint Cp of the inner edge 51*b* of the pressing pad 51 in the origin position lies on the center line CL.

Figure 20:
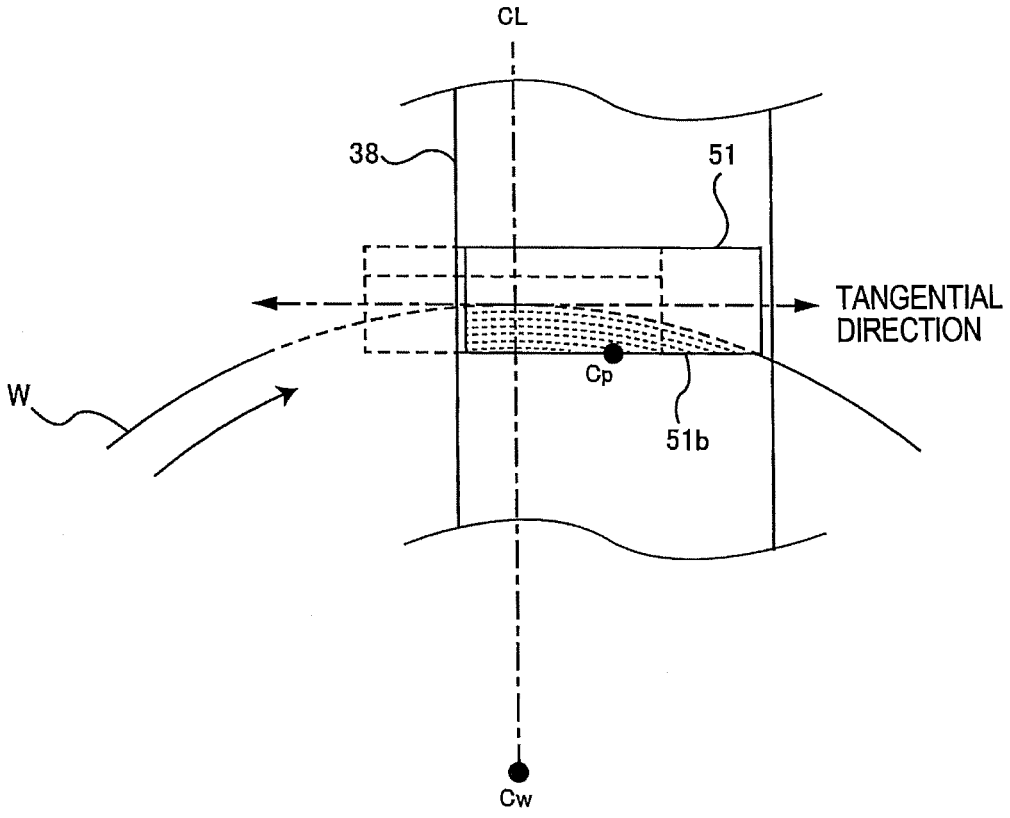
FIG. 20 is a diagram showing a state in which the pressing pad is displaced in the tangential direction by a predetermined distance from the origin position.

When polishing the wafer W, the pressing pad 51 is displaced by a predetermined distance from the origin position in the tangential direction which is perpendicular to the center line CL, as shown in FIG. 20. The polishing tape 38 is pressed against the wafer W with the pressing pad 51 in the displaced position. Also according to this embodiment, the area of contact (i.e., the contact length) between the polishing tape 38 and the outer region in the horizontal surface of the wafer edge portion can be reduced without changing the area of contact between the polishing tape 38 and the inner region in the horizontal surface. A flat horizontal surface can therefore be formed on the edge portion of the wafer W.

Figure 21:
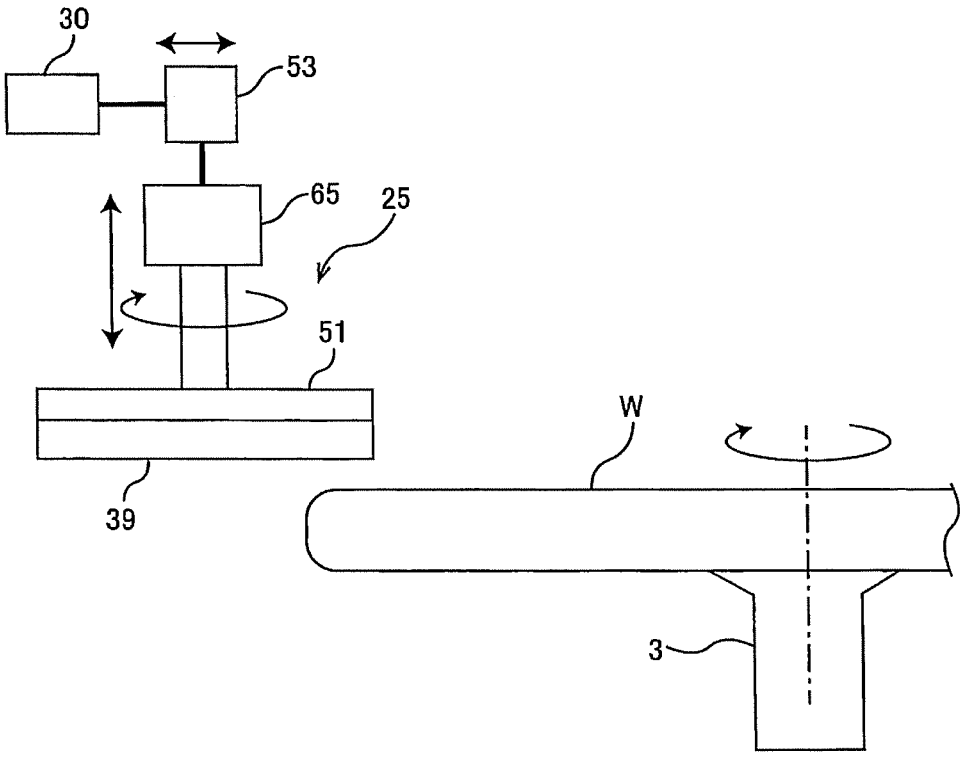
FIG. 21 is a side view schematically showing a polishing apparatus for carrying out yet another embodiment of a polishing method.

FIG. 21 is a side view schematically showing a polishing apparatus for carrying out yet another embodiment of a polishing method. Instead of the polishing tape, a fixed abrasive 39, such as a grindstone, is used as the polishing tool in this embodiment. The fixed abrasive 39 has a disk shape and is secured to a lower surface of a circular pressing member 51. The pressing member 51 is coupled to a motor 65, so that the fixed abrasive 39 is rotated together with the pressing member 51 by the motor 65. The motor 65 is coupled to a pressing device 53 for pressing the fixed abrasive 39 and the pressing member 51 toward the wafer W. The pressing device 53 is coupled to the tangentially moving mechanism 30 for moving the fixed abrasive 39 and the pressing member 51 in the tangential direction of the wafer W.

Figure 22:
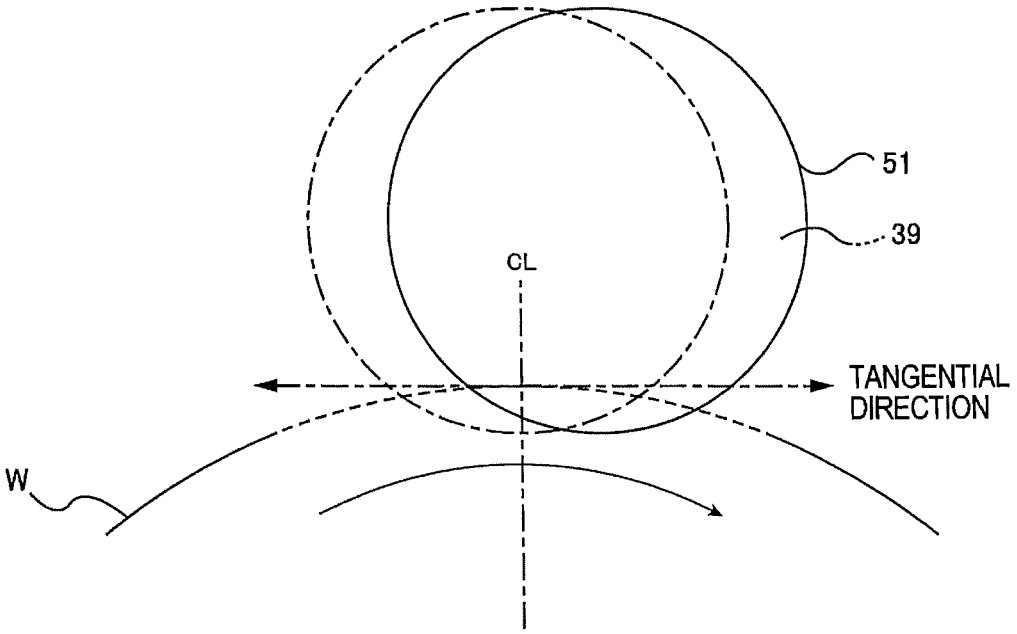
FIG. 22 is a plan view of a wafer and a fixed abrasive shown in FIG. 21.

FIG. 22 is a plan view of the wafer W and the fixed abrasive 39 shown in FIG. 21. When polishing the wafer W, the fixed abrasive 39 and the pressing member 51 are displaced by a predetermined distance from the origin position in the tangential direction which is perpendicular to the center line CL, as shown in FIG. 22. The fixed abrasive 39 is pressed against the wafer W by the pressing member 51 in the displaced position.

Figure 23:
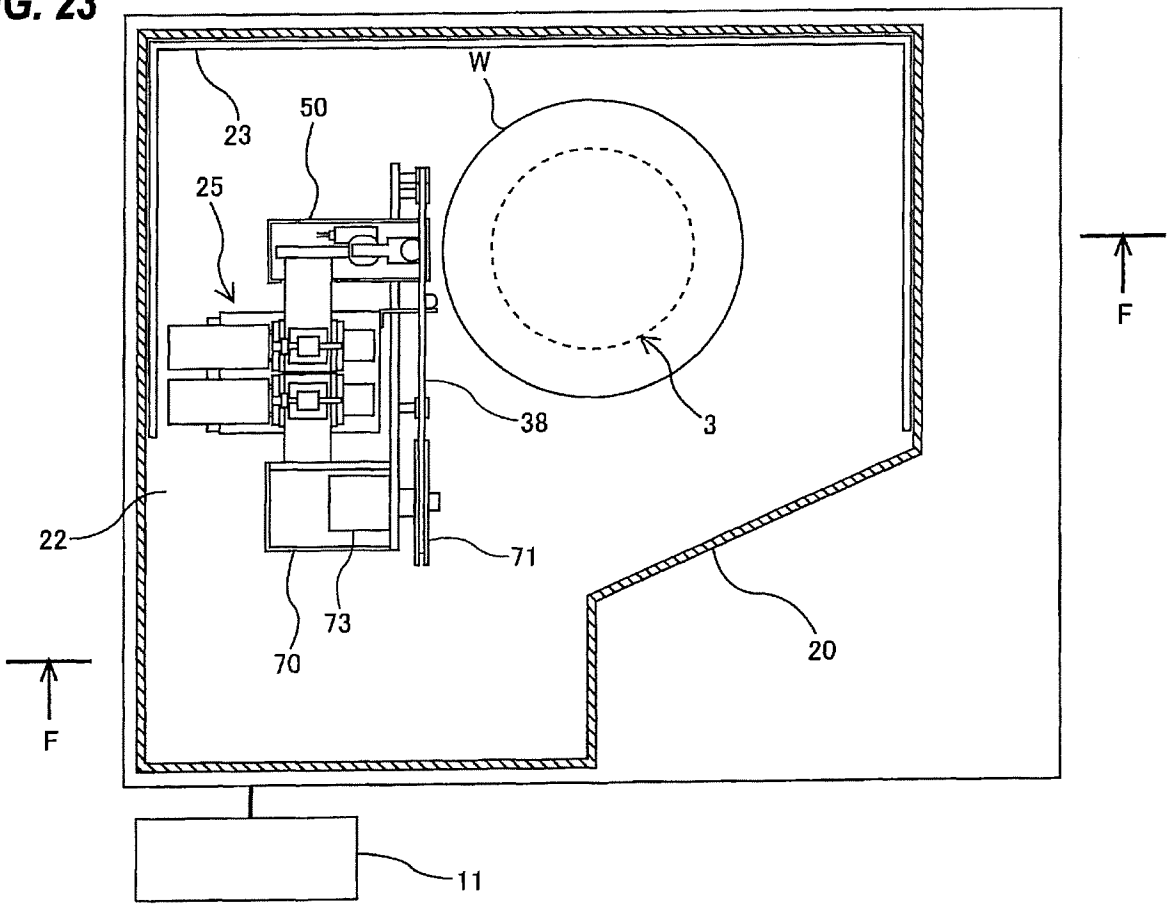
FIG. 23 is a plan view showing a polishing apparatus.
Figure 24:
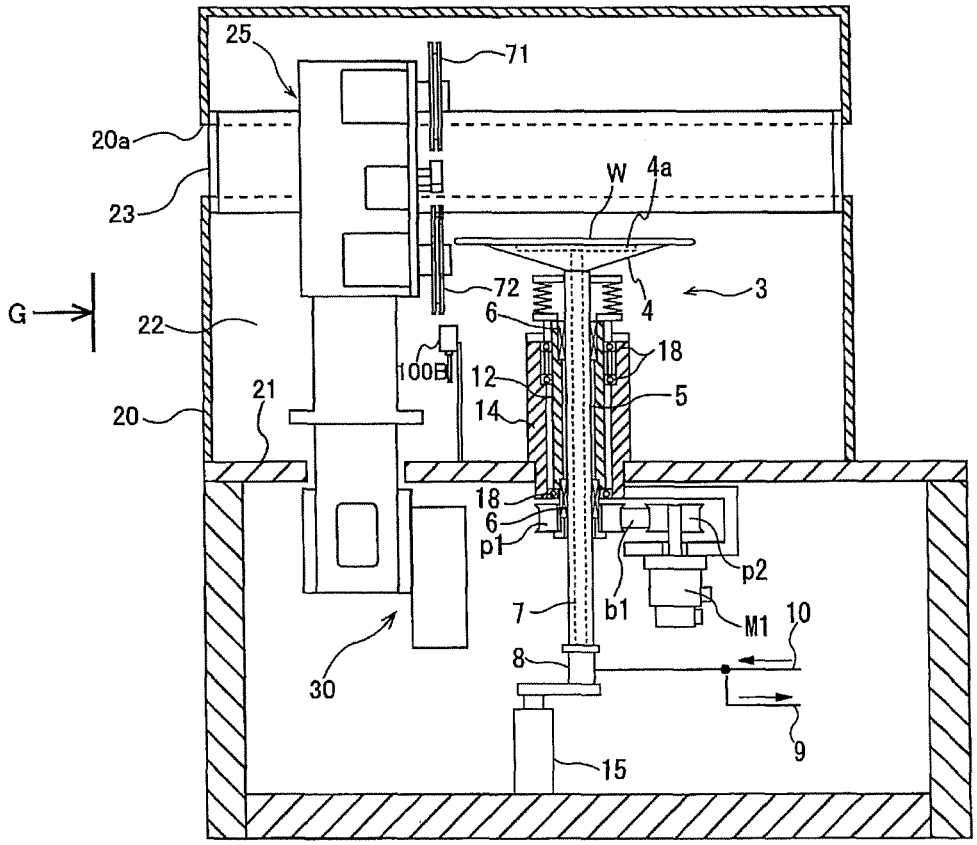
FIG. 24 is a cross-sectional view taken along line F-F in FIG. 23.
Figure 25:
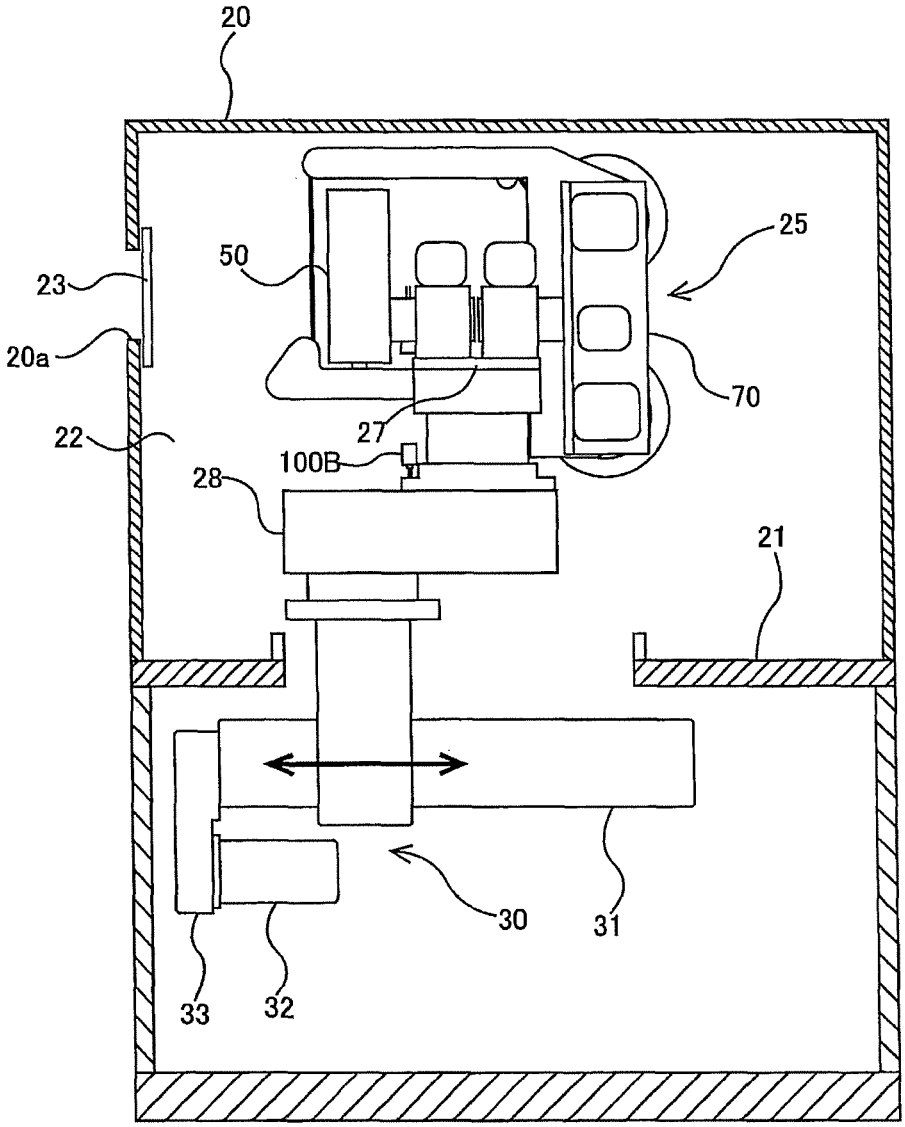
FIG. 25 is a view from a direction indicated by arrow G in FIG. 24.

Next, the details of the polishing apparatus that can perform the above-discussed embodiments of the polishing method will be described. FIG. 23 is a plan view showing a polishing apparatus according to an embodiment, FIG. 24 is a cross-sectional view taken along line F-F in FIG. 23, and FIG. 25 is a view from a direction indicated by arrow G in FIG. 24. The polishing apparatus according to the embodiment includes the wafer holder 3 configured to hold the wafer (substrate) W (i.e., a workpiece to be polished) horizontally and to rotate the wafer W. FIG. 23 shows a state in which the wafer holder 3 holds the wafer W. This wafer holder 3 has a holding stage 4 configured to hold a lower surface of the wafer W by a vacuum suction, a hollow shaft 5 coupled to a central portion of the holding stage 4, and a motor M1 for rotating the hollow shaft 5. The wafer W is placed onto the holding stage 4 such that a center of the wafer W is aligned with a central axis of the hollow shaft 5.

The holding stage 4 is located in a polishing chamber 22 that is defined by a partition 20 and a base plate 21. The partition 20 has an entrance 20*a* through which the wafer W is transported into and removed from the polishing chamber 22. This entrance 20*a* is in the shape of a horizontal cutout and can be closed with a shutter 23.

The hollow shaft 5 is supported by ball spline bearings (i.e., linear motion bearings) 6 which allow the hollow shaft 5 to move vertically. The holding stage 4 has an upper surface with grooves 4*a*. These grooves 4*a* communicate with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing the wafer W from the holding stage 4 after processing. By selectively coupling the vacuum line 9 and the nitrogen-gas supply line 10 to the communication passage 7, the wafer W can be held on the upper surface of the holding stage 4 by the vacuum suction and can be released from the upper surface of the holding stage 4.

A pulley p1 is coupled to the hollow shaft 5, and a pulley p2 is mounted to a rotational shaft of the motor M1. The hollow shaft 5 is rotated by the motor M1 through the pulley p1, the pulley p2, and a belt b1 riding on these pulleys p1 and p2. The ball spline bearing 6 is a bearing that allows the hollow shaft 5 to move freely in its longitudinal direction. The ball spline bearings 6 are secured to a cylindrical casing 12. Therefore, the hollow shaft 5 can move linearly up and down relative to the casing 12, and the hollow shaft 5 and the casing 12 rotate in unison. The hollow shaft 5 is coupled to a pneumatic cylinder (elevating device) 15, so that the hollow shaft 5 and the holding stage 4 are elevated and lowered by the pneumatic cylinder 15.

Radial bearings 18 are provided between the casing 12 and the casing 14, so that the casing 12 is rotatably supported by the radial bearings 18. With these structures, the wafer holder 3 can rotate the wafer W about its central axis and can elevate and lower the wafer W along its central axis.

A polishing unit 25 for polishing a peripheral portion of the wafer W is provided radially outwardly of the wafer W held by the wafer holder 3. This polishing unit 25 is located in the polishing chamber 22. As shown in FIG. 25, the polishing unit 25 in its entirety is secured to a mount base 27, which is coupled to a polishing-unit moving mechanism 30 via an arm block 28.

The polishing-unit moving mechanism 30 has a ball screw mechanism 31 that holds the arm block 28, a motor 32 for driving the ball screw mechanism 31, and a power transmission mechanism 33 that couples the ball screw mechanism 31 and the motor 32 to each other. The power transmission mechanism 33 is constructed by pulleys, a belt, and the like. As the motor 32 operates, the ball screw mechanism 31 moves the arm block 28 in directions indicated by arrows in FIG. 25 to thereby move the polishing unit 25 in its entirety in a tangential direction of the wafer W. This polishing-unit moving mechanism 30 also serves as oscillation mechanism for oscillating the polishing unit 25 at a predetermined amplitude and a predetermined speed.

The polishing unit 25 includes a polishing head 50 for polishing the periphery of the wafer W using a polishing tape 38, and a polishing-tape supply and collection mechanism 70 for supplying the polishing tape 38 to the polishing head 50 and collecting the polishing tape 38 from the polishing head 50. The polishing head 50 is a top-edge polishing head for polishing the top edge portion of the wafer W by pressing a polishing surface of the polishing tape 38 downwardly against the peripheral portion of the wafer W. The polishing-tape supply and collection mechanism 70 also serves as polishing-tape supporting mechanism for supporting the polishing tape 38 parallel to the surface of the wafer W.

Figure 26:
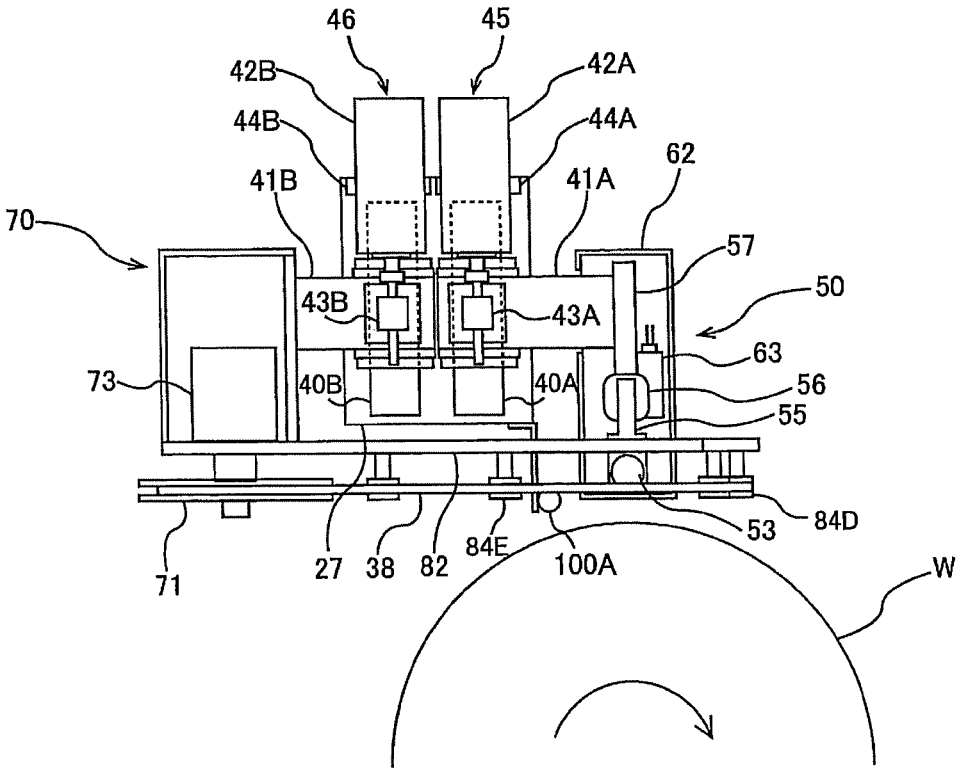
FIG. 26 is a plan view of a polishing head and a polishing-tape supply and collection mechanism.
Figure 27:
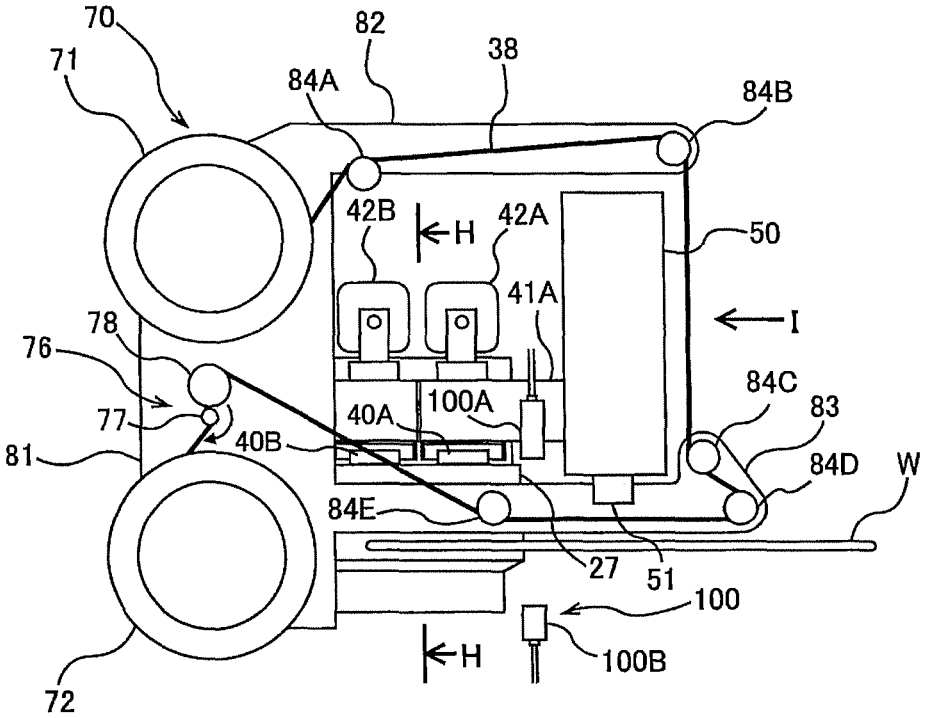
FIG. 27 is a front view of the polishing head and the polishing-tape supply and collection mechanism.
Figure 28:
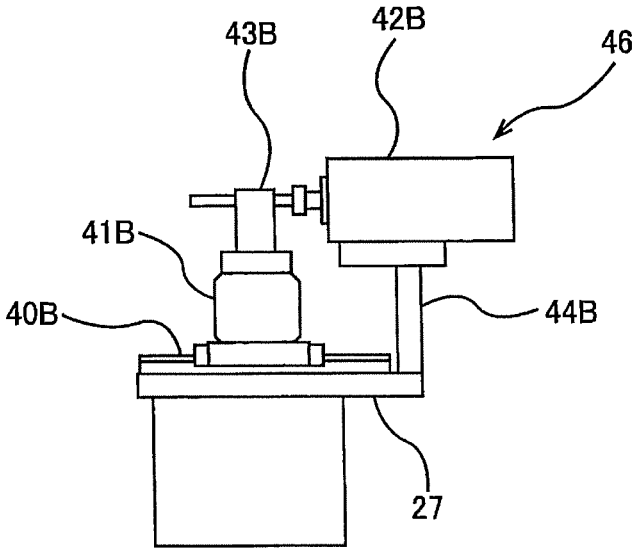
FIG. 28 is a cross-sectional view taken along line H-H in FIG. 27.
Figure 29:
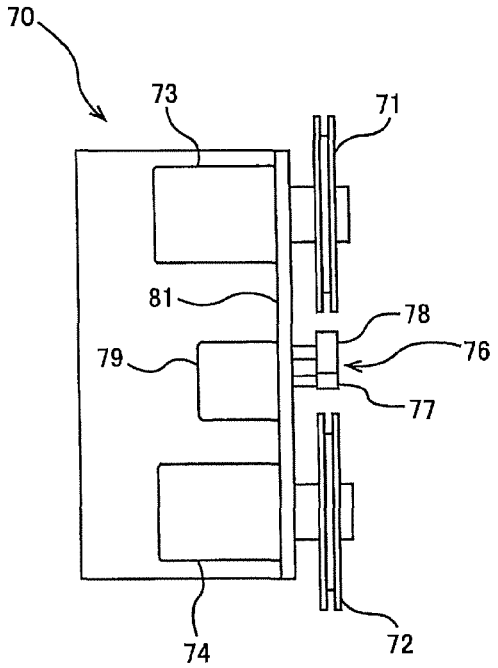
FIG. 29 is a side view of the polishing-tape supply and collection mechanism shown in FIG. 27.
Figure 30:
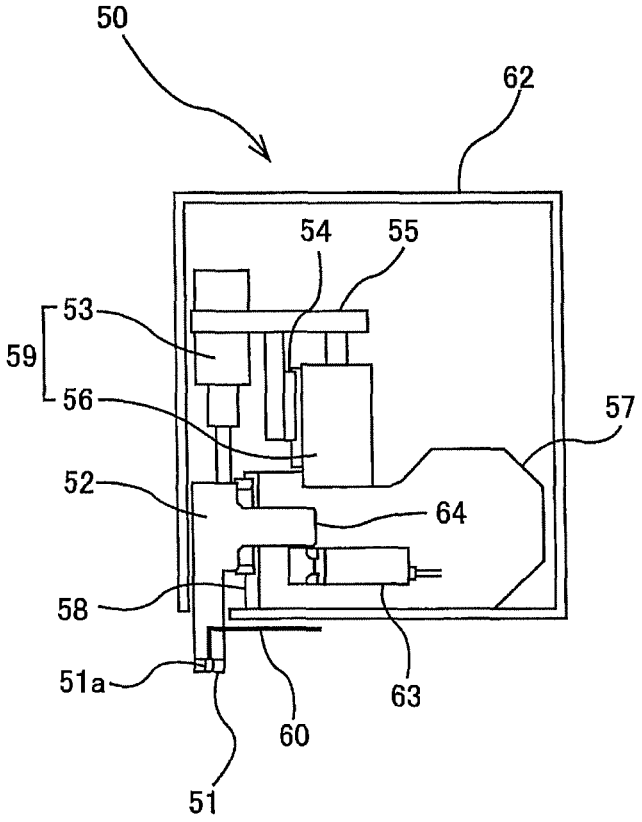
FIG. 30 is a vertical cross-sectional view of the polishing head as viewed from a direction indicated by arrow I in FIG. 27.

FIG. 26 is a plan view of the polishing head 50 and the polishing-tape supply and collection mechanism 70, FIG. 27 is a front view of the polishing head 50 and the polishing-tape supply and collection mechanism 70, FIG. 28 is a cross-sectional view taken along line H-H in FIG. 27, FIG. 29 is a side view of the polishing-tape supply and collection mechanism 70 shown in FIG. 27, and FIG. 30 is a vertical cross-sectional view of the polishing head 50 as viewed from a direction indicated by arrow I in FIG. 27.

Two linear motion guides 40A and 40B, which extend parallel to the radial direction of the wafer W, are disposed on the mount base 27. The polishing head 50 and the linear motion guide 40A are coupled to each other via a coupling block 41A. Further, the polishing head 50 is coupled to a motor 42A and a ball screw 43A for moving the polishing head 50 along the linear motion guide 40A (i.e., in the radial direction of the wafer W). More specifically, the ball screw 43A is secured to the coupling block 41A, and the motor 42A is secured to the mount base 27 through a support member 44A. The motor 42A is configured to rotate a screw shaft of the ball screw 43A, so that the coupling block 41A and the polishing head 50 (which is coupled to the coupling block 41A) are moved along the linear motion guide 40A. The motor 42A, the ball screw 43A, and the linear motion guide 40A constitute a first moving mechanism 45 for moving the polishing head 50 in the radial direction of the wafer W held on the wafer holder 3.

Similarly, the polishing-tape supply and collection mechanism 70 and the linear motion guide 40B are coupled to each other via a coupling block 41B. Further, the polishing-tape supply and collection mechanism 70 is coupled to a motor 42B and a ball screw 43B for moving the polishing-tape supply and collection mechanism 70 along the linear motion guide 40B (i.e., in the radial direction of the wafer W). More specifically, the ball screw 43B is secured to the coupling block 41B, and the motor 42B is secured to the mount base 27 through a support member 44B. The motor 42B is configured to rotate a screw shaft of the ball screw 43B, so that the coupling block 41B and the polishing-tape supply and collection mechanism 70 (which is coupled to the coupling block 41B) are moved along the linear motion guide 40B. The motor 42B, the ball screw 43B, and the linear motion guide 40B constitute a tape moving mechanism (a second moving mechanism) 46 for moving the polishing tape 38 and the polishing-tape supply and collection mechanism (i.e., the polishing-tape supporting mechanism) 70 in the radial direction of the wafer W held on the wafer holder 3.

As shown in FIG. 30, the polishing head 50 has the pressing pad 51 for pressing the polishing tape 38 against the wafer W, a pad holder 52 that holds the pressing pad 51, and the pneumatic cylinder 53 as the pressing device configured to push down the pad holder 52 (and the pressing pad 51). The pneumatic cylinder 53 is held by a holding member 55. Further, the holding member 55 is coupled to a pneumatic cylinder 56 serving as a lifter via a linear motion guide 54 extending in a vertical direction. As a gas (e.g., air) is supplied to the pneumatic cylinder 56 from a non-illustrated gas supply source, the pneumatic cylinder 56 pushes up the holding member 55, whereby the holding member 55, the pneumatic cylinder 53, the pad holder 52, and the pressing pad 51 are elevated along the linear motion guide 54.

In this embodiment, the vertically-moving mechanism 59 for moving the pressing pad 51 in the direction perpendicular to the wafer surface is constituted by the pneumatic cylinder 53 and the pneumatic cylinder 56. The motor 42A, the ball screw 43A, and the linear motion guide 40A constitute the first moving mechanism 45, which also serves as radially-moving mechanism for moving the pressing pad 51 and the vertically-moving mechanism 59 in the radial direction of the wafer W. Further, the polishing-unit moving mechanism 30 serves as tangentially-moving mechanism for moving the pressing pad 51 (and the pneumatic cylinder 53 as a pressing device) in the tangential direction of the wafer W.

The pneumatic cylinder 56 is secured to a mount member 57 that is fixed to the coupling block 41A. The mount member 57 and the pad holder 52 are coupled to each other via a linear motion guide 58 extending in the vertical direction. When the pad holder 52 is pushed down by the pneumatic cylinder 53, the pressing pad 51 is moved downward along the linear motion guide 58 to thereby press the polishing tape 38 against the peripheral portion of the wafer W. The pressing pad 51 is made of resin (e.g., PEEK (polyetheretherketone)), metal (e.g., stainless steel), or ceramic (e.g., SiC (silicon carbide)).

The pressing pad 51 has through-holes 51*a* extending in the vertical direction. A vacuum line 60 is coupled to the through-holes 51*a*. This vacuum line 60 has a valve (not shown in the drawings) therein. By opening this valve, a vacuum is produced in the through-holes 51*a* of the pressing pad 51. When the vacuum is produced in the through-holes 51*a* with the pressing pad 51 in contact with an upper surface of the polishing tape 38, this upper surface of the polishing tape 38 is held on a lower surface of the pressing pad 51. Only one through-hole 51*a* may be provided in the pressing pad 51. The shape of the through-hole 51*a* is not limited particularly so long as the polishing tape 38 is held securely on the pressing pad 51 via the vacuum suction. For example, the through-hole 51*a* may be in the form of slit. One or more through-holes 51*a* with different shapes may be provided.

The pad holder 52, the pneumatic cylinder 53, the holding member 55, the pneumatic cylinder 56, and the mount member 57 are housed in a box 62. A lower portion of the pad holder 52 projects from a bottom of the box 62, and the pressing pad 51 is attached to this lower portion of the pad holder 52. The position sensor 63 for detecting a vertical position of the pressing pad 51 is disposed in the box 62. This position sensor 63 is mounted to the mount member 57. A dog 64, which serves as a sensor target, is provided on the pad holder 52. The position sensor 63 is configured to detect the vertical position of the pressing pad 51 based on the vertical position of the dog 64.

Figure 31:
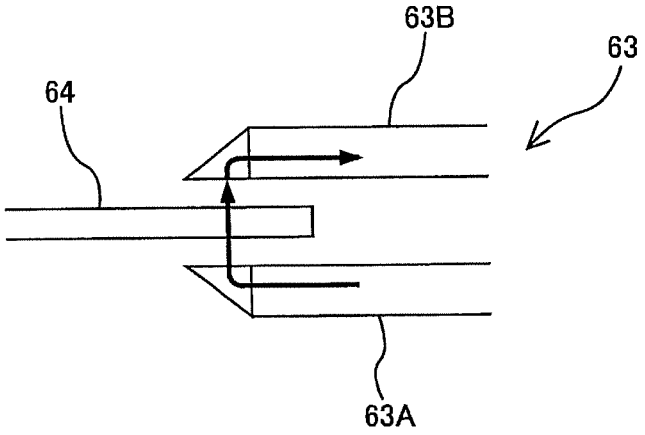
FIG. 31 is a view of a position sensor and a dog as viewed from above.

FIG. 31 is a view of the position sensor 63 and the dog 64 as viewed from above. The position sensor 63 has a light emitter 63A and a light receiver 63B. When the dog 64 is lowered together with the pad holder 52 (and the pressing pad 51), a part of light emitted from the light emitter 63A is interrupted by the dog 64. Therefore, the position of the dog 64, i.e., the vertical position of the pressing pad 51, can be detected from a quantity of the light received by the light receiver 63B. The position sensor 63 shown in FIG. 31 is a so-called transmission optical sensor. However, other type of position sensor may be used.

The polishing-tape supply and collection mechanism 70 has a supply reel 71 for supplying the polishing tape 38 to the polishing head 50 and a collection reel 72 for collecting the polishing tape 38 from the polishing head 50. The supply reel 71 and the collection reel 72 are coupled to tension motors 73 and 74, respectively. These tension motors 73 and 74 are configured to apply predetermined torque to the supply reel 71 and the collection reel 72 to thereby exert a predetermined tension on the polishing tape 38.

A polishing-tape advancing mechanism 76 is provided between the supply reel 71 and the collection reel 72. This polishing-tape advancing mechanism 76 has a tape-advancing roller 77 for advancing the polishing tape 38, a nip roller 78 that presses the polishing tape 38 against the tape-advancing roller 77, and a tape-advancing motor 79 for rotating the tape-advancing roller 77. The polishing tape 38 is interposed between the tape-advancing roller 77 and the nip roller 78. By rotating the tape-advancing roller 77 in a direction indicated by arrow in FIG. 27, the polishing tape 38 is advanced from the supply reel 71 to the collection reel 72.

The tension motors 73 and 74 and the tape-advancing motor 79 are mounted to a pedestal 81. This pedestal 81 is secured to the coupling block 41B. The pedestal 81 has two support arms 82 and 83 extending from the supply reel 71 and the collection reel 72 toward the polishing head 50. A plurality of guide rollers 84A, 84B, 84C, 84D, and 84E for supporting the polishing tape 38 are provided on the support arms 82 and 83. The polishing tape 38 is guided by these guide rollers 84A to 84E so as to surround the polishing head 50.

The extending direction of the polishing tape 38 is perpendicular to the radial direction of the wafer W as viewed from above. The two guide rollers 84D and 84E, which are located below the polishing head 50, support the polishing tape 38 such that the polishing surface of the polishing tape 38 is parallel to the surface (upper surface) of the wafer W. Further, the polishing tape 38 extending between these guide rollers 84D and 84E is parallel to the tangential direction of the wafer W. There is a gap in the vertical direction between the polishing tape 38 and the wafer W.

The polishing apparatus further has a tape-edge detection sensor 100 for detecting a position of the edge of the polishing tape 38. This tape-edge detection sensor 100 is a transmission optical sensor, as well as the above-described position sensor 63. The tape-edge detection sensor 100 has a light emitter 100A and a light receiver 100B. The light emitter 100A is secured to the mount base 27 as shown in FIG. 26, and the light receiver 100B is secured to the base plate 21 that defines the polishing chamber 22 as shown in FIG. 24. This tape-edge detection sensor 100 is configured to detect the position of the edge of the polishing tape 38 based on a quantity of the light received by the light receiver 100B.

Figure 32:
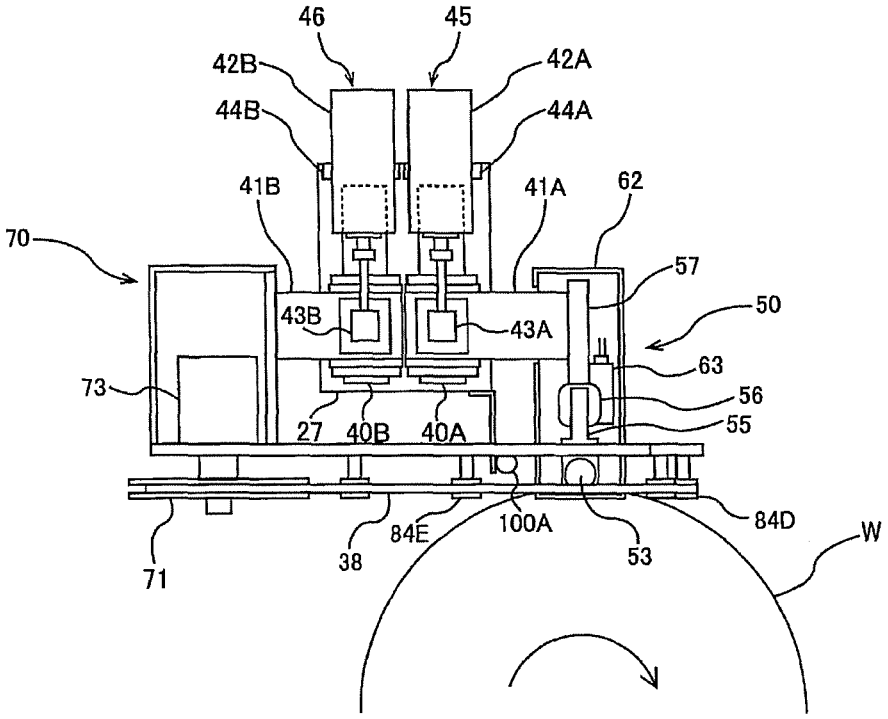
FIG. 32 is a view showing the polishing head and the polishing-tape supply and collection mechanism that have been moved to predetermined polishing positions.

As shown in FIG. 32, when polishing the wafer W, the polishing head 50 and the polishing-tape supply and collection mechanism 70 are moved to their predetermined polishing positions, respectively, by the motors 42A and 42B and the ball screws 43A and 43B. The polishing tape 38 at the polishing position extends in the tangential direction of the wafer W as viewed from above the wafer W. Therefore, the polishing-tape supply and collection mechanism 70 serves as polishing-tape supporting mechanism for supporting the polishing tape 38 parallel to the surface of the wafer W such that the polishing tape 38 extends along the tangential direction of the wafer W.

Figure 33:
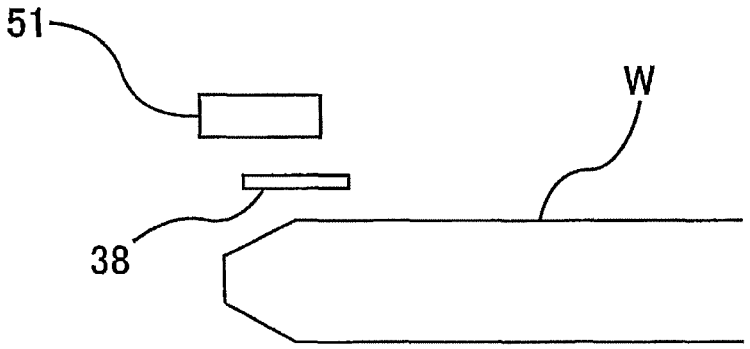
FIG. 33 is a schematic view of the pressing pad, the polishing tape, and the wafer at their polishing positions when performing the polishing method shown in FIG. 3A through FIG. 3D and the polishing method shown in FIG. 4 and FIG. 7, as viewed from the lateral direction.
Figure 34:
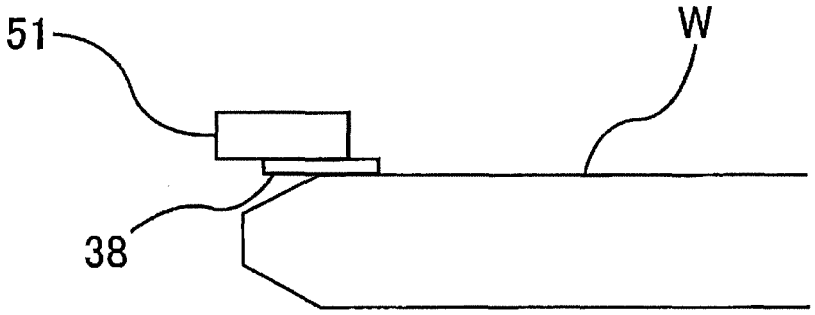
FIG. 34 is a view showing a state in which the pressing pad presses the polishing tape against the wafer.

FIG. 33 is a schematic view of the pressing pad 51, the polishing tape 38, and the wafer W at their polishing positions when performing the polishing method shown in FIG. 3A through FIG. 3D and the polishing method shown in FIG. 4 and FIG. 7, as viewed from the lateral direction. As shown in FIG. 33, the polishing tape 38 is located above the edge portion of the wafer W, and the pressing pad 51 is located above the polishing tape 38. FIG. 34 is a view showing a state in which the pressing pad 51 is pressing the polishing tape 38 against the wafer W.

Figure 35:
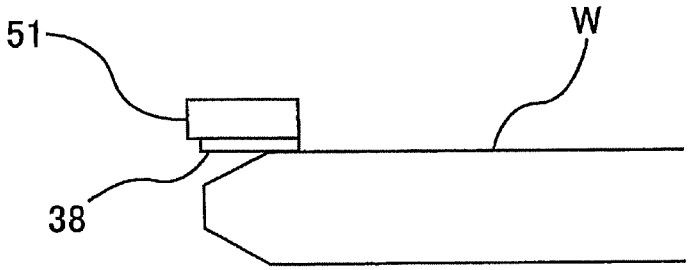
FIG. 35 is a schematic view showing the pressing pad, the polishing tape, and the wafer when performing the polishing method shown in FIG. 10 and FIG. 13 as viewed from the lateral direction.

FIG. 35 is a schematic view showing the pressing pad 51, the polishing tape 38, and the wafer W when performing the polishing method shown in FIG. 10 and FIG. 13 as viewed from the lateral direction, and shows a state in which the pressing pad 51 presses the polishing tape 38 against the wafer W. As shown in FIG. 35, the edge of the pressing pad 51 and the edge of the polishing tape 38 at their polishing positions coincide with each other. That is, the polishing head 50 and the polishing-tape supply and collection mechanism 70 are moved independently to their respective polishing positions such that the edge of the pressing pad 51 and the edge of the polishing tape 38 coincide with each other. In another embodiment, the edge of the pressing pad 51 and the edge of the polishing tape 38 may not coincide perfectly with each other. For example, the edge of the polishing tape 38 may protrude from the edge of the pressing pad 51 by 20 μm to 100 μm.

The polishing tape 38 is a long and narrow strip-shaped polishing tool. Although a width of the polishing tape 38 is basically constant throughout its entire length, there may be a slight variation in the width of the polishing tape 38 in some parts thereof. As a result, the position of the edge of the polishing tape 38 at its polishing position may vary from wafer to wafer. On the other hand, the position of the pressing pad 51 at its polishing position is constant at all times. Thus, the position of the edge of the polishing tape 38 is detected by the above-described tape-edge detection sensor 100 before the polishing tape 38 is moved to its polishing position.

Figure 36A:
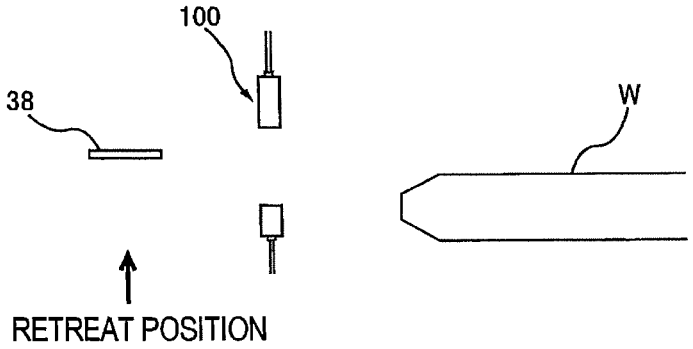
FIG. 36A, FIG. 36B, and FIG. 36C are views illustrating operations for detecting the edge of the polishing tape.
Figure 36B:
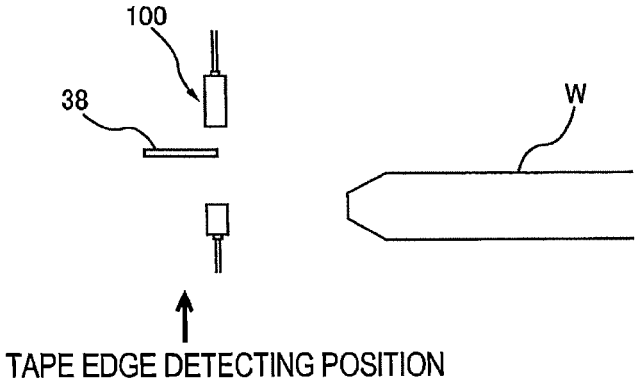
Figure 36C:
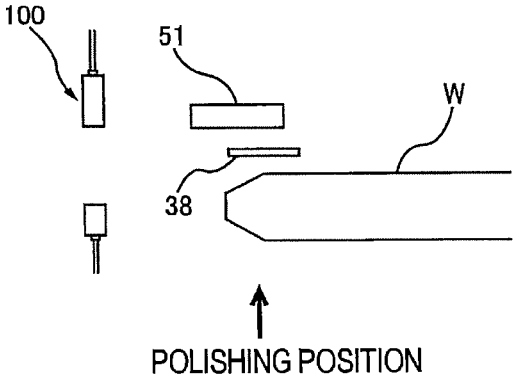

FIG. 36A through FIG. 36C are views illustrating operations for detecting the edge of the polishing tape 38. Prior to polishing of the wafer W, the polishing tape 38 is moved from a retreat position shown in FIG. 36A to a tape-edge detecting position shown in FIG. 36B. In this tape-edge detecting position, the position of the wafer-side edge of the polishing tape 38 is detected by the tape-edge detection sensor 100. Then, as shown in FIG. 36C, the polishing tape 38 is moved to the polishing position such that a part of the polishing tape 38 projects from the edge of the pressing pad 51 by a predetermined width or such that the edge of the polishing tape 38 coincides with the edge of the pressing pad 51 as shown in FIG. 35.

The position of the edge of the pressing pad 51 at the polishing position is stored in advance in the polishing controller 11 (see FIG. 23). Therefore, the polishing controller 11 can calculate the travel distance of the polishing tape 38 for allowing the edge of the polishing tape 38 to coincide with the edge of the pressing pad 51 from the detected edge position of the polishing tape 38 and the edge position of the pressing pad 51. In this manner, the travel distance of the polishing tape 38 is determined based on the detected position of the edge of the polishing tape 38. Therefore, the polishing tape 38 can be moved to a predetermined position regardless of a variation in the width of the polishing tape 38.

In the polishing method shown in FIG. 13, a part of the polishing tape 38 may project from the inner edge of the pressing pad 51 inwardly in the radial direction of the wafer W as shown in FIG. 34 when the pressing pad 51 presses the polishing tape 38 against the edge portion of the wafer W.

Next, polishing operations of the polishing apparatus having the above-described structures will be described. The following operations of the polishing apparatus are controlled by the polishing controller 11 shown in FIG. 23. The wafer W is held by the wafer holder 3 such that a film (e.g., a device layer) formed on the surface thereof faces upward, and further the wafer W is rotated about its center. Liquid (e.g., pure water) is supplied to the center of the rotating wafer W from a liquid supply mechanism (not shown in the drawings). The pressing pad 51 of the polishing head 50 and the polishing tape 38 are moved to the predetermined polishing positions, respectively, as shown in FIG. 33.

Figure 37A:
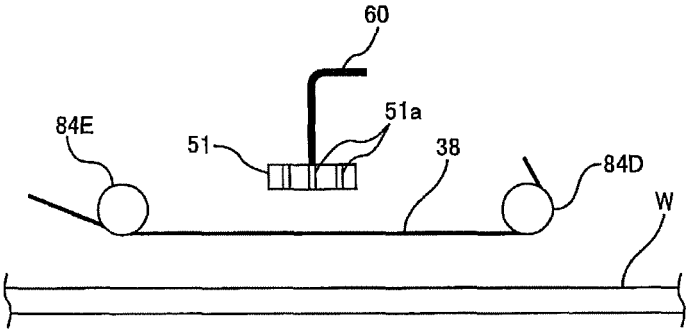
FIG. 37A is a view of the polishing tape and the pressing pad at the polishing positions as viewed from the radial direction of the wafer.
Figure 37B:
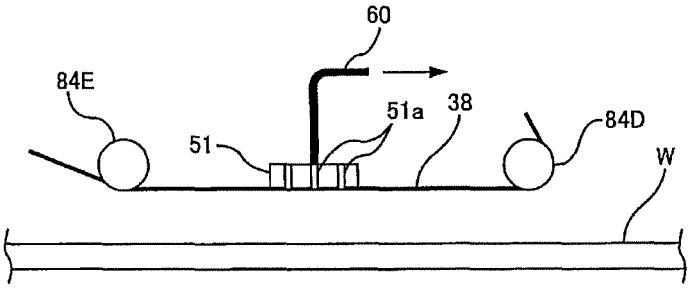
FIG. 37B is a view showing the pressing pad whose lower surface contacts an upper surface of the polishing tape.
Figure 37C:
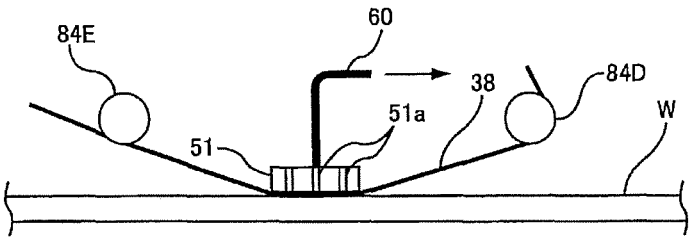
FIG. 37C is a view showing the pressing pad when pressing the polishing tape downwardly against the wafer.

FIG. 37A is a view of the polishing tape 38 and the pressing pad 51 at the polishing positions as viewed from the radial direction of the wafer W. The pressing pad 51 shown in FIG. 37A is in an upper position as a result of being elevated by the pneumatic cylinder 56 (see FIG. 30). In this position, the pressing pad 51 is located above the polishing tape 38. Subsequently, the operation of the pneumatic cylinder 56 is stopped and as a result a piston rod thereof is lowered. The pressing pad 51 is lowered until its lower surface contacts the upper surface of the polishing tape 38 as shown in FIG. 37B. In this state, the vacuum is produced in the through-holes 51*a* of the pressing pad 51 through the vacuum line 60 to enable the lower surface of the pressing pad 51 to hold the polishing tape 38. While holding the polishing tape 38, the pressing pad 51 is lowered by the pneumatic cylinder 53 (see FIG. 30) to press the polishing surface of the polishing tape 38 against the peripheral portion of the wafer W at a predetermined polishing pressure, as shown in FIG. 37C. The polishing pressure is a pressure applied from the polishing tape 38 to the edge portion of the wafer W. The polishing pressure can be adjusted by the pressure of the gas supplied to the pneumatic cylinder 53.

When the polishing method shown in FIG. 13 is performed, the pressing pad 51 is displaced by a predetermined distance from the preset origin position in the tangential direction as shown in FIG. 16, and the polishing tape 38 is pressed against the wafer W with the pressing pad 51 in the displaced position. As can be seen in FIG. 16, by displacing the position of the pressing pad 51 in the tangential direction of the wafer W, the area of contact (i.e., the contact length) between the polishing tape 38 and the outer region in the horizontal surface of the wafer edge portion can be reduced without changing the area of contact between the polishing tape 38 and the inner region in the horizontal surface. The polishing tape 38 can therefore form the flat horizontal surface on the edge portion of the wafer W.

The edge portion of the wafer W is polished by the sliding contact between the rotating wafer W and the polishing tape 38. In order to increase the polishing rate of the wafer W, the polishing tape 38 and the pressing pad 51 may be oscillated in the tangential direction of the wafer W by the polishing-unit moving mechanism (tangentially-moving mechanism) 30 during polishing of the wafer W. During polishing, the liquid (e.g., pure water) is supplied onto the center of the rotating wafer W, so that the wafer W is polished in the presence of the water. The liquid, supplied to the wafer W, spreads over the upper surface of the wafer W in its entirety via a centrifugal force. This liquid can prevent polishing debris from contacting devices of the wafer W. As described above, during polishing, the polishing tape 38 is held on the pressing pad 51 by the vacuum suction. Therefore, a relative change in position between the polishing tape 38 and the pressing pad 51 is prevented. As a result, a polishing position and a polishing profile can be stable. Further, even when the polishing pressure is increased, the relative position between the polishing tape 38 and the pressing pad 51 does not change. Therefore, a polishing time can be shortened.

The vertical position of the pressing pad 51 during polishing of the wafer W is detected by the position sensor 63. Therefore, a polishing end point can be detected from the vertical position of the pressing pad 51. For example, polishing of the edge portion of the wafer W can be terminated when the vertical position of the pressing pad 51 has reached a predetermined target position. This target position is determined according to a target amount of polishing.

When polishing of the wafer W is terminated, supply of the gas to the pneumatic cylinder 53 is stopped, whereby the pressing pad 51 is elevated to the position shown in FIG. 37B. At the same time, the vacuum suction of the polishing tape 38 is stopped. Further, the pressing pad 51 is elevated by the pneumatic cylinder 56 to the position shown in FIG. 37A. The polishing head 50 and the polishing-tape supply and collection mechanism 70 are moved to the retreat positions shown in FIG. 26. The polished wafer W is elevated by the wafer holder 3 and transported to the exterior of the polishing chamber 22 by hands of a non-illustrated transporting device. Before polishing of the next wafer is started, the polishing tape 38 is advanced from the supply reel 71 to the collection reel 72 by a predetermined distance by the tape-advancing mechanism 76, so that a new polishing surface is used for polishing of the next wafer. When the polishing tape 38 is estimated to be clogged with the polishing debris, the polished wafer W may be polished again with the new polishing surface after the polishing tape 38 is advanced by the predetermined distance. Clogging of the polishing tape 38 can be estimated from, for example, the polishing time and the polishing pressure.

Polishing of the wafer W may be performed while advancing (or moving) the polishing tape 38 in its longitudinal direction at a predetermined speed by the tape-advancing mechanism 76. In order to increase the polishing rate of the wafer W, the movement direction of the polishing tape 38 may be opposite to the movement direction of the edge portion of the rotating wafer W. It is also possible to advance the polishing tape 38 in its longitudinal direction by the polishing-tape advancing mechanism 76 while holding the polishing tape 38 on the pressing pad 51 by the vacuum suction. In some situations, the polishing tape 38 may not be held on the pressing pad 51 by the vacuum suction.

Figure 38A:
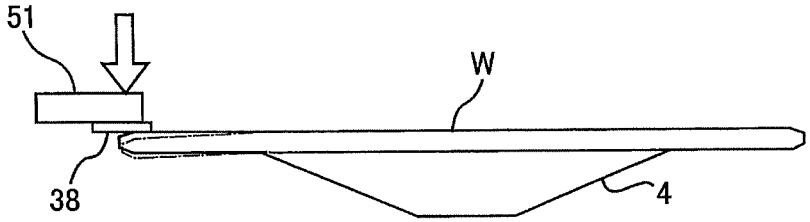
FIG. 38A is a view showing the wafer that is bent when the pressing pad presses the polishing tape against the wafer.
Figure 38B:
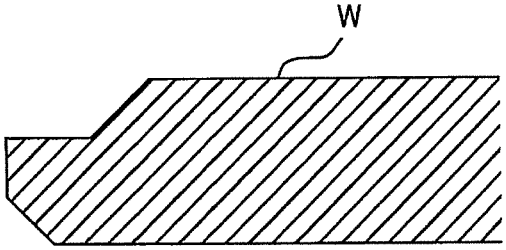
FIG. 38B is a cross-sectional view of the wafer that has been polished in a bent state as shown in FIG. 38A.
Figure 39:
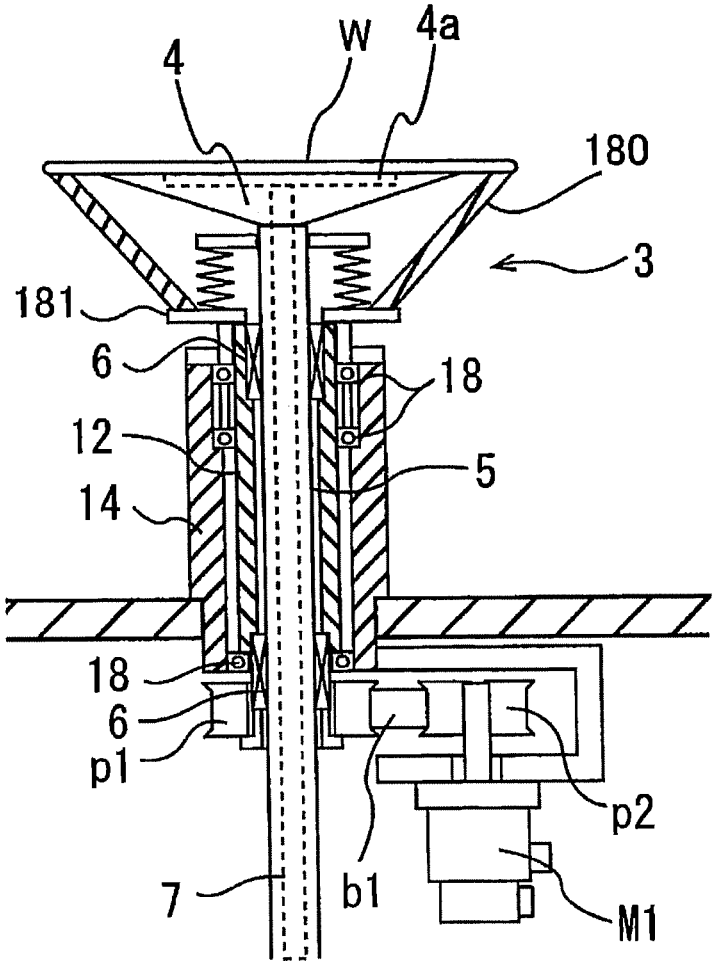
FIG. 39 is a vertical cross-sectional view of a wafer holder provided with a supporting stage.

As shown in FIG. 38A, when an increased polishing pressure is exerted on the wafer W, the wafer W may be greatly bent by the polishing pressure of the pressing pad 51, and as a result, an oblique polished surface may be formed on the wafer W as shown in FIG. 38B. Thus, in an embodiment shown in FIG. 39 a supporting stage 180 for supporting a lower surface of the peripheral portion of the wafer W is provided in the wafer holder 3. The same parts as those shown in FIG. 24 will not be described below repetitively. The supporting stage 180 is fixed to a supporting stage base 181. This supporting stage base 181 is fixed to the upper end of the casing 12 and rotates in unison with the casing 12. Accordingly, the supporting stage 180 rotates in unison with the casing 12 and the holding stage 4.

Figure 40:
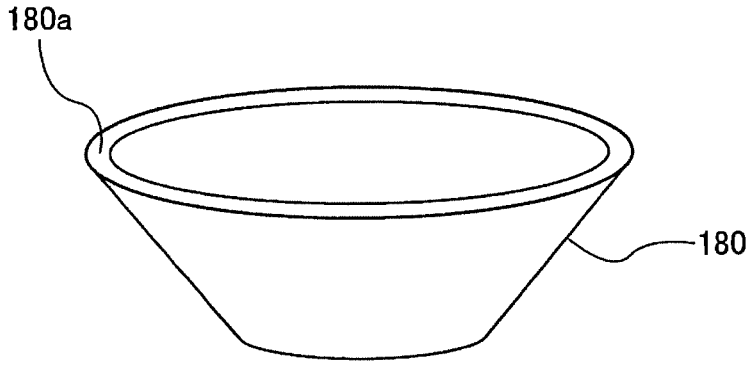
FIG. 40 is a perspective view of the supporting stage.
Figure 52A:
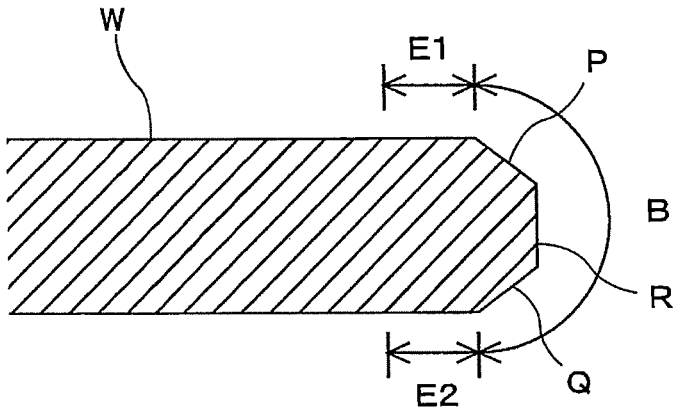
FIG. 52A and FIG. 52B are cross-sectional views each showing a peripheral portion of a wafer.
Figure 52B:
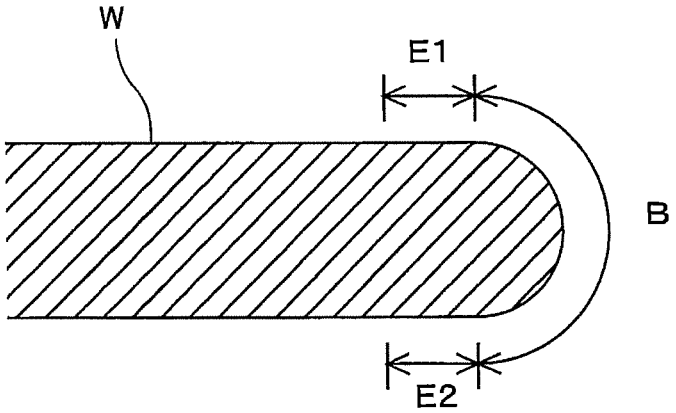
Figure 53:
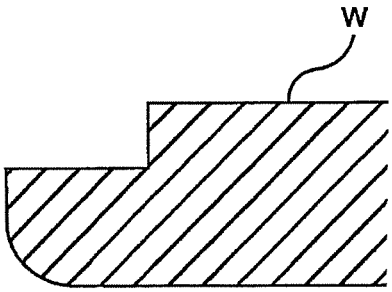
FIG. 53 is a view showing a vertical surface and a horizontal surface formed on the edge portion of the wafer.
Figure 54:
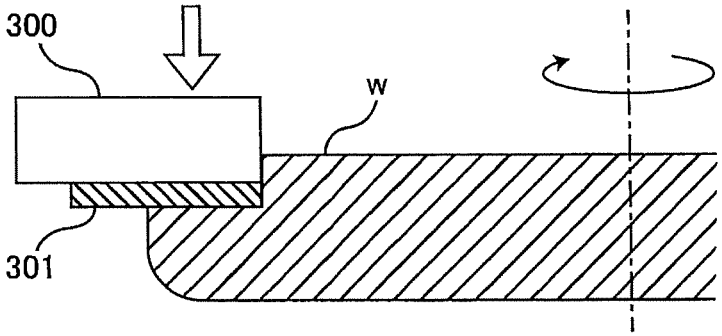
FIG. 54 is a diagram illustrating a polishing method for forming the vertical surface and the horizontal surface shown in FIG. 53.
Figure 55A:
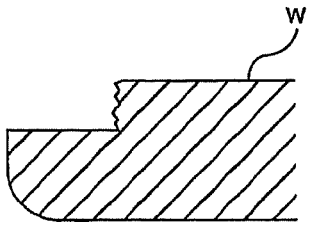
FIG. 55A, FIG. 55B, FIG. 55C, and FIG. 55D are enlarged views each showing a cross section of a wafer polished by the conventional polishing method.
Figure 55B:
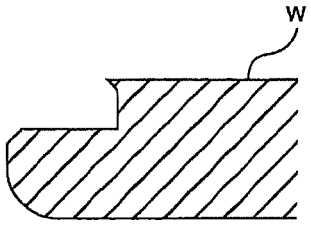
Figure 55C:
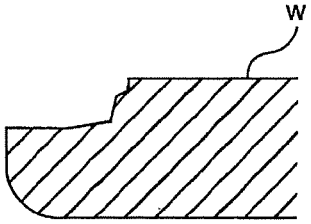
Figure 55D:
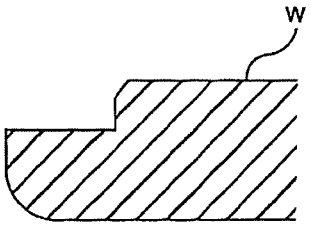

The supporting stage 180 has an inverted truncated cone shape as shown in FIG. 40 for supporting the lower surface of the peripheral portion of the wafer W in its entirety. The lower surface of the peripheral portion of the wafer W supported by the supporting stage 180 is a region including at least the bottom edge portion E2 shown in FIG. 52A and FIG. 52B. The supporting stage 180 has an annular upper surface 180*a* that provides a supporting surface for supporting the lower surface of the peripheral portion of the wafer W. When the wafer W is polished, an outermost edge of the supporting stage 180 and an outermost edge of the wafer W approximately coincide with each other.

Use of such supporting stage 180 can prevent the wafer W from being bent when the pressing pad 51 presses the polishing tape 38 against the wafer W. Therefore, the polishing tape 38 can polish the edge portion of the wafer W to form the vertical surface and the horizontal surface on the edge portion of the wafer W. Because the supporting stage 180 supports the lower surface of the peripheral portion of the wafer W in its entirety, the polishing tape 38 can polish the peripheral portion of the wafer W uniformly, compared with a case of using a conventional wafer supporting structure that supports only a part of the wafer.

Figure 41:
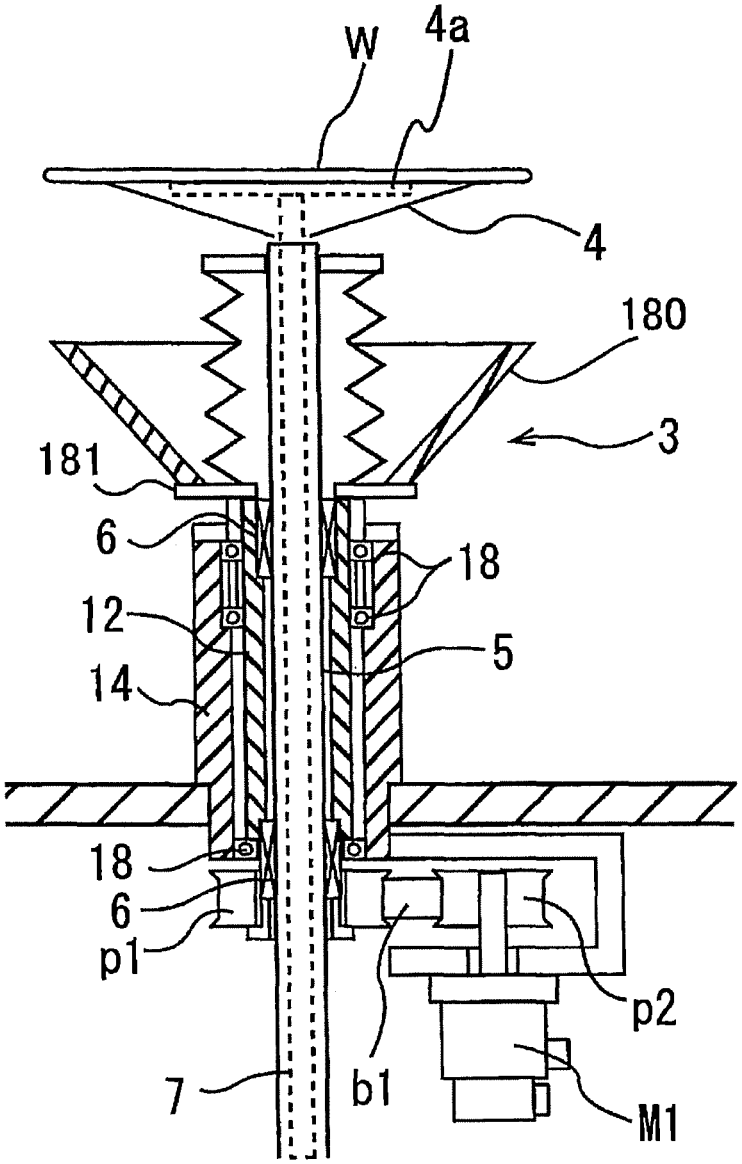
FIG. 41 is a view showing a state in which a holding stage and the wafer held on the upper surface of the holding stage are elevated relative to the supporting stage.

The ball spline bearings 6 are disposed between the hollow shaft 5 and the casing 12, so that the hollow shaft 5 can move up and down relative to the casing 12. Therefore, the holding stage 4 coupled to an upper end of the hollow shaft 5 can move up and down relative to the casing 12 and the supporting stage 180. FIG. 41 shows a state in which the holding stage 4 and the wafer W held on the upper surface of the holding stage 4 are elevated relative to the supporting stage 180.

Figure 42:
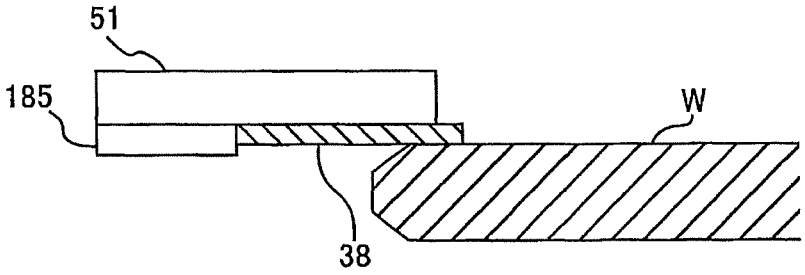
FIG. 42 is a view showing an embodiment having a tape stopper.

The polishing tape 38 may receive a horizontal load due to contact with the wafer W or an influence of the shape of the peripheral portion of the wafer W. As a result, the polishing tape 38 may be forced to move outwardly of the wafer W. Thus, tape stopper 185 for restricting a horizontal movement of the polishing tape 38 is provided on the pressing pad 51 as shown in FIG. 42. The tape stopper 185 is arranged outwardly of the polishing tape 38 with respect to the radial direction of the wafer W so as to restrict an outward movement of the polishing tape 38. This tape stopper 185 can prevent the polishing tape 38 from moving outwardly of the wafer W. Therefore, a polishing profile and a polishing width of the wafer W can be stable.

Figure 43:
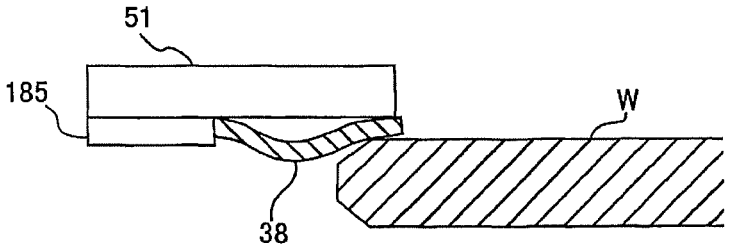
FIG. 43 is a view showing a state in which the polishing tape is distorted when receiving a horizontal load.

When the tape stopper 185 receives the outward movement of the polishing tape 38, the polishing tape 38 may be distorted as shown in FIG. 43. Thus, in an embodiment shown in FIG. 44, in order to prevent the distortion of the polishing tape 38, a tape cover 186 is provided in proximity to the polishing surface of the polishing tape 38. The tape cover 186 is secured to the tape stopper 185 and is arranged so as to cover a most part of the polishing surface of the polishing tape 38. The tape cover 186 is located below the polishing tape 38 such that a small gap dg is formed between the polishing surface of the polishing tape 38 and an upper surface of the tape cover 186. The polishing tape 38 is arranged between the pressing pad 51 and the tape cover 186. By providing such tape cover 186, the polishing tape 38 can be prevented from being distorted and can be kept flat. Therefore, the polishing profile and the polishing width of the wafer W can be stable.

Figure 44:
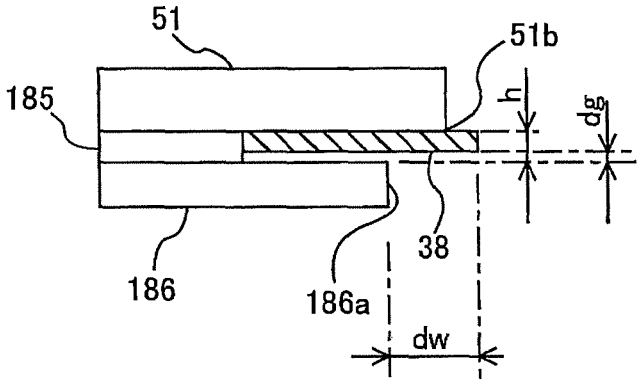
FIG. 44 is a view showing an embodiment having the tape stopper and a tape cover.

As shown in FIG. 44, the polishing tape 38 is located in a space surrounded by the pressing pad 51, the tape stopper 185, and the tape cover 186. A gap h between the lower surface of the pressing pad 51 and the upper surface of the tape cover 186 is larger than a thickness of the polishing tape 38. A gap dg between the polishing tape 38 and the tape cover 186 is smaller than a thickness of the wafer W.

The tape cover 186 has an inner side surface 186*a* located outwardly of the edge 51*b* of the pressing pad 51 with respect to the radial direction of the wafer W. Therefore, the polishing surface of the polishing tape 38 is exposed by a distance dw between the edge of the polishing tape 38 and the inner side surface 186*a* of the tape cover 186. Polishing of the wafer W is performed with this exposed polishing surface.

In the structures shown in FIG. 44, the tape stopper 185 receives the horizontal load acting on the polishing tape 38. As a result, the pressing pad 51 may move outwardly together with the polishing tape 38. Such a movement of the pressing pad 51 destabilizes the polishing profile and the polishing width. Thus, in an embodiment shown in FIG. 45, a movement-restricting mechanism for restricting the outward movement of the pressing pad 51 is provided. This movement-restricting mechanism has a projecting member 190 fixed to the pressing pad 51 and further has a side stopper 191 for restricting a horizontal movement of this projecting member 190. In this embodiment, a plunger is used as the projecting member 190.

The side stopper 191 is disposed outwardly of the plunger (projecting member) 190 with respect to the radial direction of the wafer W so as to receive an outward movement of the plunger 190. The side stopper 191 is secured to the lower surface of the box 62 of the polishing head 50, so that a position of the side stopper 191 is fixed. The plunger 190 and the side stopper 191 are arranged in proximity to each other, and a gap dr between the plunger 190 and the side stopper 191 is in a range of 10 μm to 100 μm. With this structure, when the pressing pad 51 moves outwardly upon receiving the horizontal load from the polishing tape 38 during polishing, the plunger 190 is brought into contact with the side stopper 191, whereby the outward movements of the pressing pad 51 and the polishing tape 38 are restricted. Therefore, the polishing profile and the polishing width of the wafer W can be stable.

Figure 45:
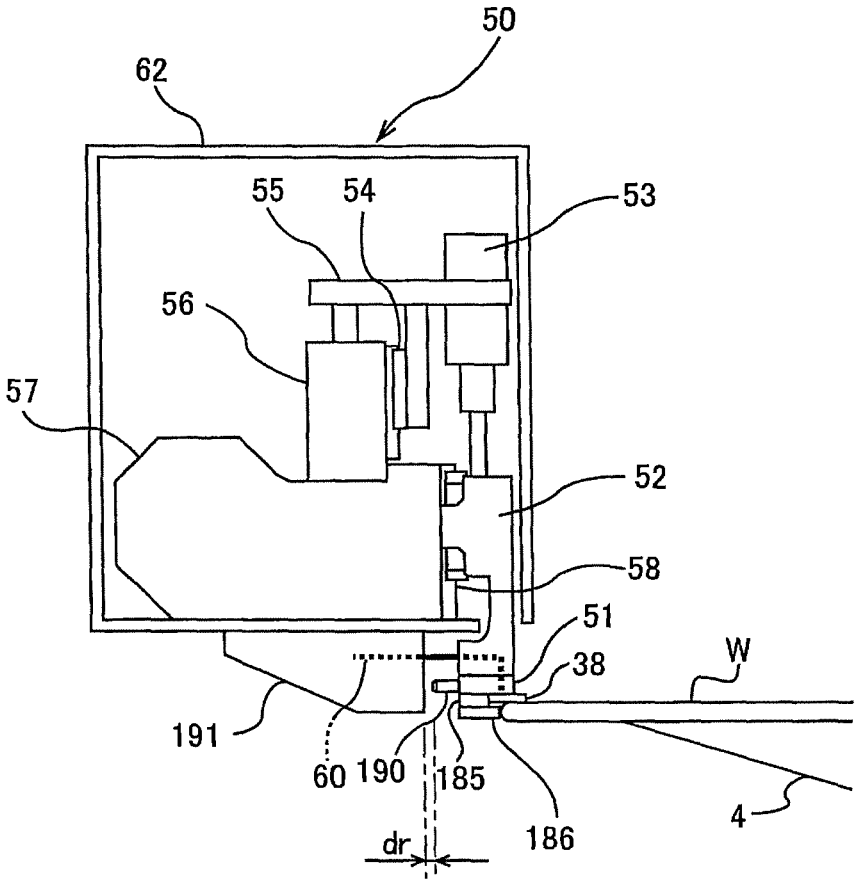
FIG. 45 is a view showing an embodiment having a movement-restricting mechanism for restricting an outward movement of the pressing pad.
Figure 46:
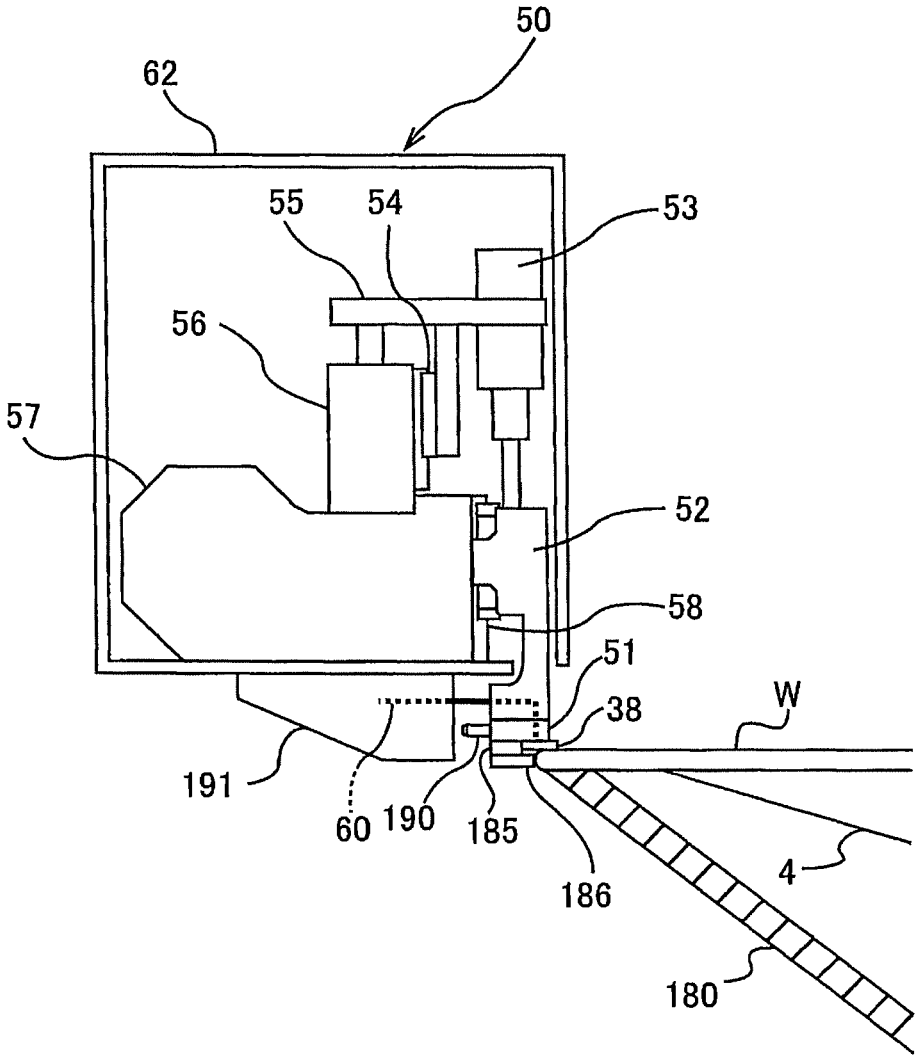
FIG. 46 is a view showing a combination of the embodiment shown in FIG. 39 and the embodiment shown in FIG. 45.

The embodiments shown in FIG. 39 through FIG. 45 can be combined in an appropriate manner. For example, FIG. 46 shows an example in which the supporting stage 180 shown in FIG. 39 and the polishing head 50 shown in FIG. 45 are combined. This structure shown in FIG. 46 can prevent the deflection of the wafer W and can further prevent the movement and the distortion of the polishing tape 38.

Figure 47:
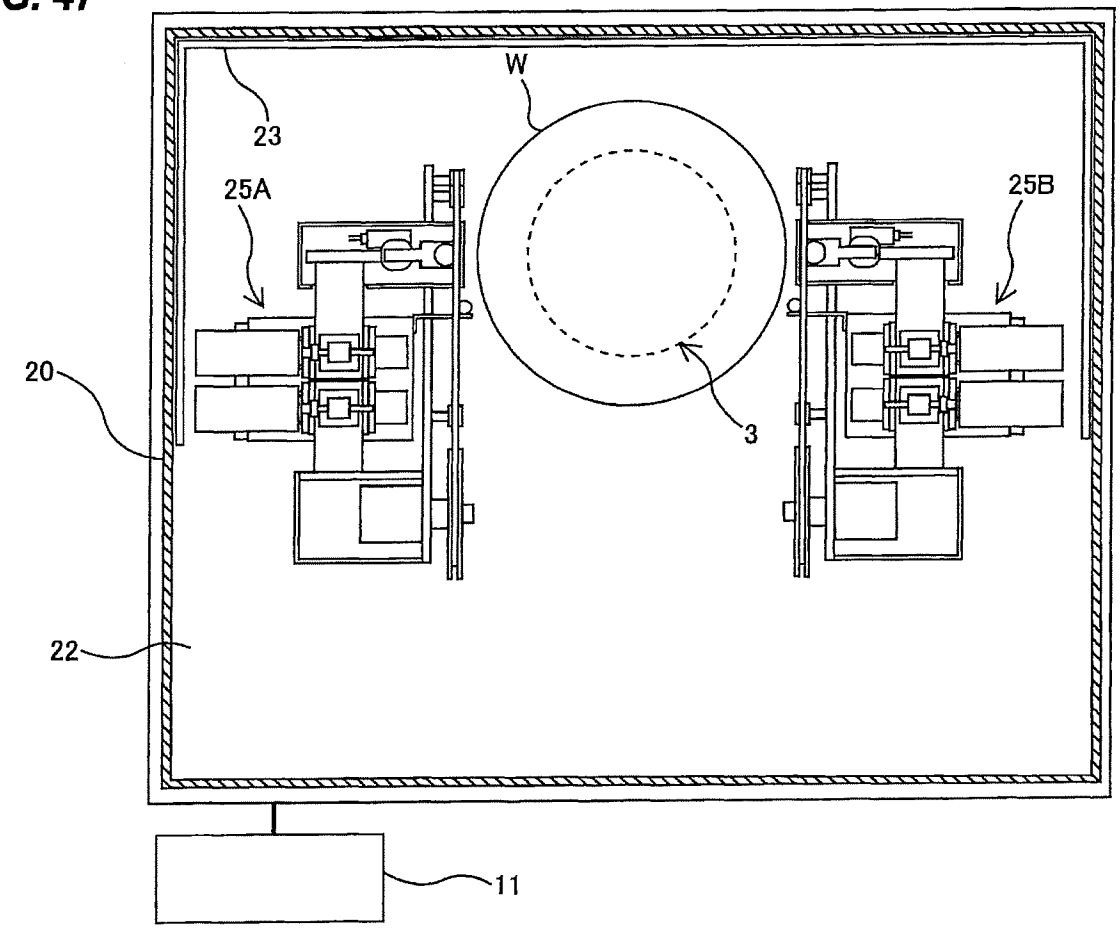
FIG. 47 is a plan view of a polishing apparatus having a plurality of polishing units.

FIG. 47 is a plan view of a polishing apparatus having a plurality of polishing units. This polishing apparatus includes first polishing unit 25A and second polishing unit 25B disposed in the polishing chamber 22. The polishing units 25A, 25B have the same construction as the above-discussed polishing unit 25 and a duplicate description thereof is omitted. The polishing units 25A, 25B are disposed symmetrically with respect to the center of the wafer W held by the wafer holder 3. A first polishing-unit moving mechanism (not shown) is provided for moving the first polishing unit 25A, and a second polishing-unit moving mechanism (not shown) is provided for moving the second polishing unit 25B. These first and second polishing-unit moving mechanisms have the same configurations as those of the above-discussed polishing-unit moving mechanism 30.

The first polishing unit 25A and the second polishing unit 25B may use different types of polishing tapes. For example, the first polishing unit 25A may perform rough polishing of the wafer W, and the second polishing unit 25B may perform finish polishing of the wafer W. The polishing method shown in FIG. 7 can be performed with use of the polishing apparatus shown in FIG. 47.

Figure 48:
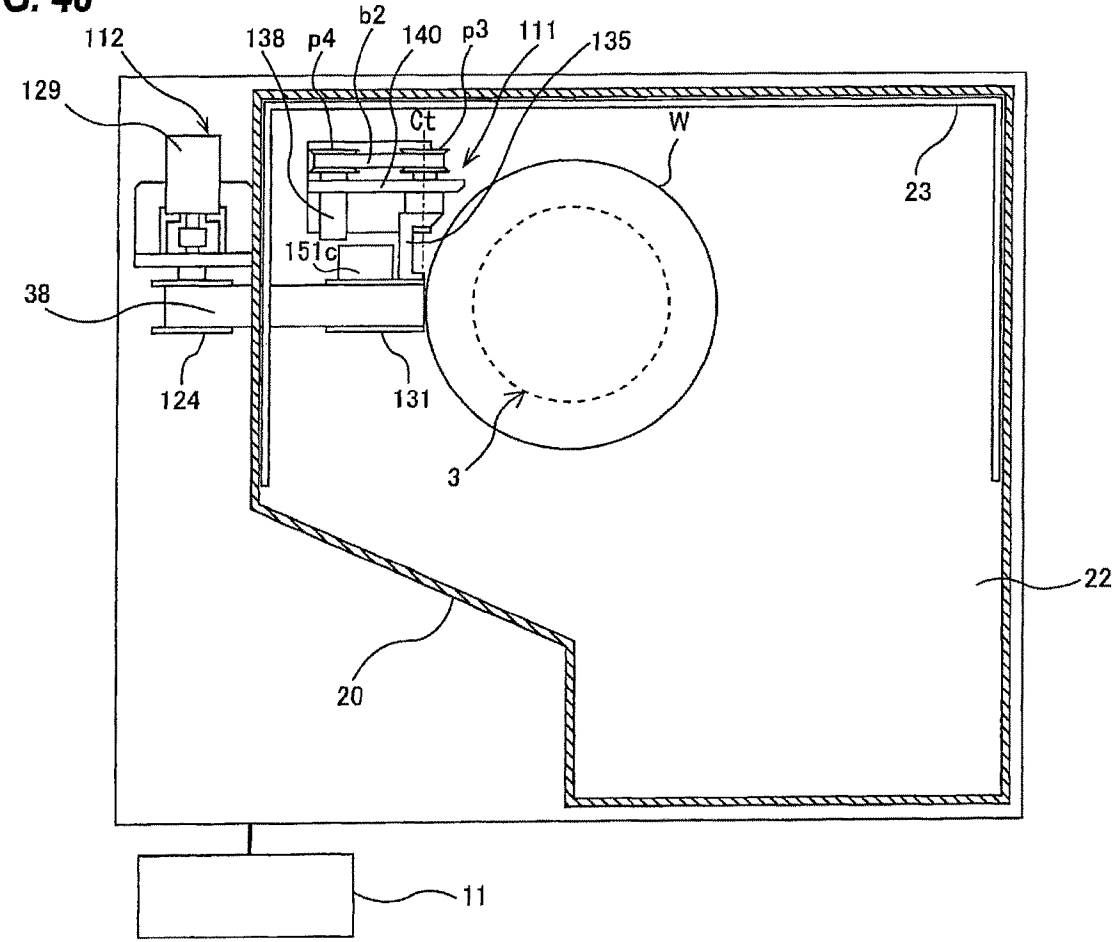
FIG. 48 is a plan view showing another embodiment of the polishing apparatus.
Figure 49:
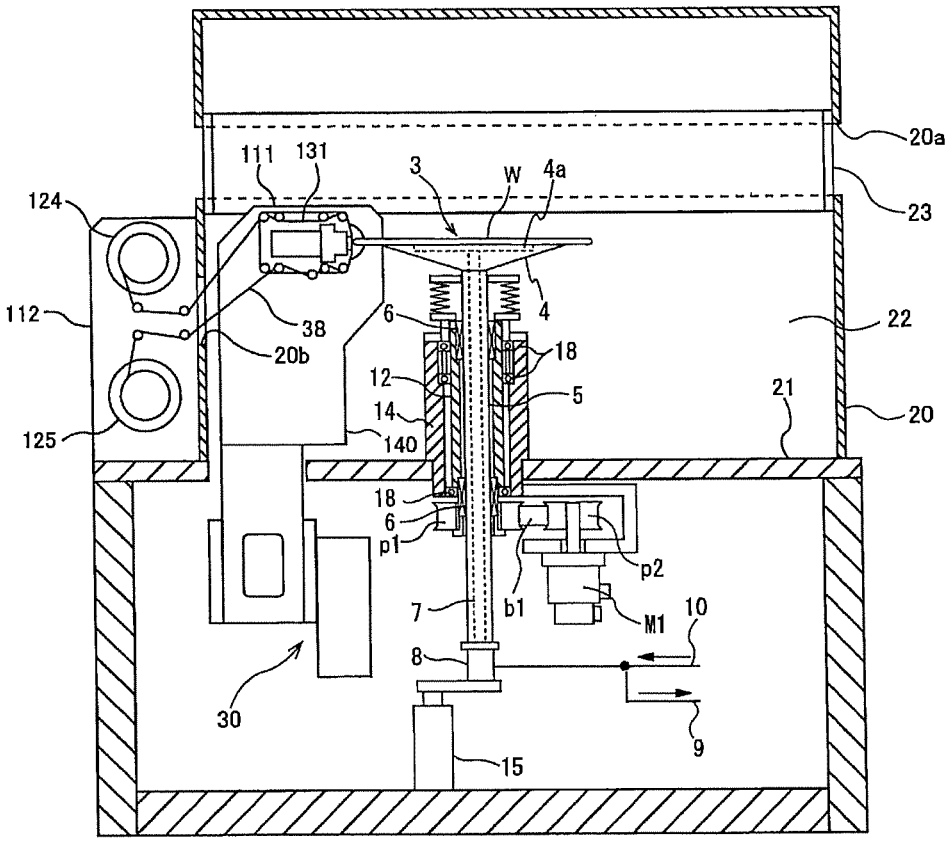
FIG. 49 is a vertical cross-sectional view of the polishing apparatus shown in FIG. 48.

Next, the details of the polishing apparatus that can perform the above-discussed embodiments of the polishing method shown in FIG. 19 and FIG. 20 will be described. FIG. 48 is a plan view showing the polishing apparatus, and FIG. 49 is a vertical cross-sectional view of the polishing apparatus shown in FIG. 48. As shown in FIG. 48 and FIG. 49, the polishing apparatus includes a polishing head assembly 111 configured to press polishing tape 38 against the edge portion of the wafer W so as to polish the edge portion, and a polishing-tape supply and collection mechanism 112 for supplying the polishing tape 38 to the polishing head assembly 111. The polishing head assembly 111 is located in the polishing chamber 22, while the polishing-tape supply and collection mechanism 112 is located outside the polishing chamber 22.

The polishing-tape supply and collection mechanism 112 has a supply reel 124 for supplying the polishing tape 38 to the polishing head assembly 111, and a collection reel 125 for collecting the polishing tape 38 that has been used in polishing of the wafer W. Motors 129 and 129 are coupled to the supply reel 124 and the collection reel 125, respectively (FIG. 48 shows only the motor 129 coupled to the supply reel 124). The motors 129 and 129 are configured to apply predetermined torque to the supply reel 124 and the collection reel 125 so as to exert a predetermined tension on the polishing tape 38.

The polishing head assembly 111 has a polishing head 131 for pressing the polishing tape 38 against the peripheral portion of the wafer W. The polishing tape 38 is supplied to the polishing head 131 such that the polishing surface of the polishing tape 38 faces the wafer W. The polishing tape 38 is supplied to the polishing head 131 from the supply reel 124 through an opening 20*b* formed in the partition 20, and the polishing tape 38 that has been used in polishing of the wafer is recovered by the collection reel 125 through the opening 20*b*.

The polishing head 131 is secured to one end of an arm 135, which is rotatable about an axis Ct extending parallel to the tangential direction of the wafer W. The other end of the arm 135 is coupled to a motor 138 via pulleys p3 and p4 and a belt b2. As the motor 138 rotates in a clockwise direction and a counterclockwise direction through a certain angle, the arm 135 rotates about the axis Ct through a certain angle. In this embodiment, the motor 138, the arm 135, the pulleys p3 and p4, and the belt b2 constitute a tilting mechanism for tilting the polishing head 131 with respect to the surface of the wafer W.

The tilting mechanism is mounted to a movable base 140. This movable base 140 is coupled to the polishing-unit moving mechanism (the tangentially-moving mechanism) 30, so that the polishing head 131 and the polishing tape 38 supported thereon can move in the tangential direction of the wafer W. The polishing-tape supply and collection mechanism 112 is secured to the base plate 21.

Figure 50:
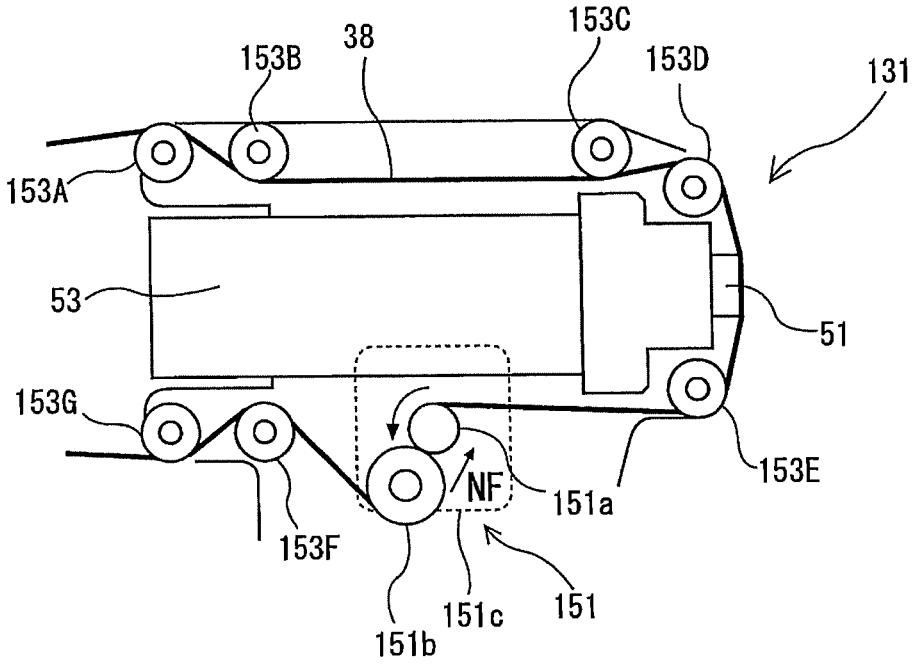
FIG. 50 is an enlarged view of a polishing head shown in FIG. 49.

FIG. 50 is an enlarged view of the polishing head 131 shown in FIG. 49. As shown in FIG. 50, the polishing head 131 has pressing pad 51 for pressing the polishing tape 38 against the edge portion of the wafer W, and pneumatic cylinder 53 as a pressing device for pressing the polishing tape 38 toward the wafer W. The polishing head 131 further has a tape-advancing mechanism 151 configured to advance the polishing tape 38 from the supply reel 124 to the collection reel 125. The polishing head 131 has plural guide rollers 153A, 153B, 153C, 153D, 153E, 153E, and 153G, which guide the travel direction of the polishing tape 38.

The tape-advancing mechanism 151 of the polishing head 131 includes a tape-advancing roller 151*a*, a nip roller 151*b*, and a motor 151*c* configured to rotate the tape-advancing roller 151*a*. The motor 151*c* is mounted to a side surface of the polishing head 131. The tape-advancing roller 151*a* is provided on a rotational shaft of the motor 151*c*. The nip roller 151*b* is adjacent to the tape-advancing roller 151*a*. The nip roller 151*b* is supported by a non-illustrated mechanism, which biases the nip roller 151*b* in a direction indicated by arrow NF in FIG. 50 (i.e., in a direction toward the tape-advancing roller 151*a*) so as to press the nip roller 151*b* against the tape-advancing roller 151*a*.

As the motor 151*c* rotates in a direction indicated by arrow in FIG. 50, the tape-sending roller 151*a* is rotated to send the polishing tape 38 from the supply reel 124 to the collection reel 125 via the polishing head 131. The nip roller 151*b* is configured to be rotatable about its own axis.

The pressing pad 51 is located at the rear side of the polishing tape 38 and the pneumatic cylinder 53 is configured to move the pressing pad 51 toward the peripheral portion of the wafer W. The polishing load on the wafer W is regulated by controlling air pressure supplied to the pneumatic cylinder 53.

Figure 51:
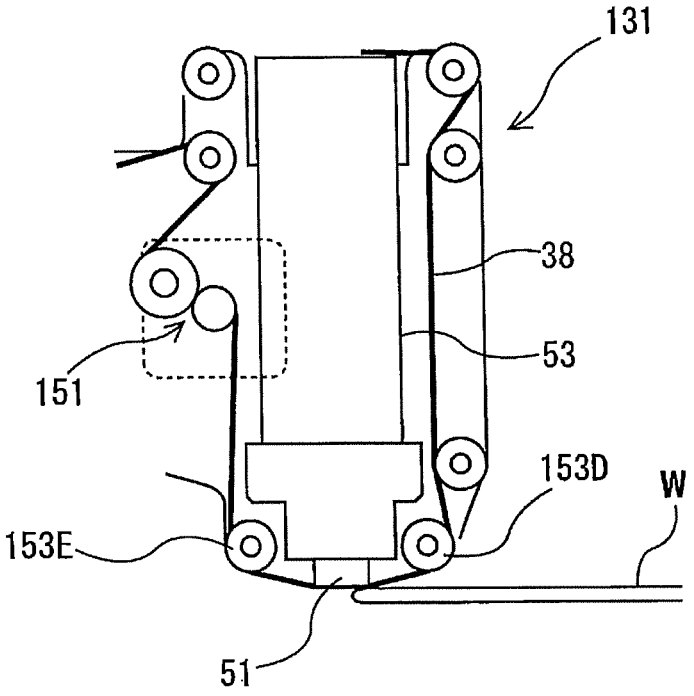
FIG. 51 is a view showing the polishing head when polishing a top edge portion of a wafer.

When polishing the edge portion of the wafer W, the polishing head 131 is inclined upwardly by the above-discussed tilting mechanism until the wafer pressing surface of the pressing pad 51 is parallel to the surface of the wafer W, as shown in FIG. 51. The polishing tape 38 is then pressed against the edge portion of the wafer W by the pressing pad 51 to polish the edge portion. The two guide rollers 153D, 153E, which are arranged at both sides of the pressing pad 51, serve as the polishing-tape supporting mechanism for supporting the polishing tape 38 such that the polishing tape 38 extends along the center line CL (see FIG. 20) as viewed from above the wafer W.

When polishing of the wafer W is performed, the pressing pad 51 is displaced by a predetermined distance from the preset origin position in the tangential direction as shown in FIG. 20, and the polishing tape 38 is pressed against the wafer W with the pressing pad 51 in the displaced position. As can be seen in FIG. 20, by displacing the position of the pressing pad 51 in the tangential direction of the wafer W, the area of contact (i.e., the contact length) between the polishing tape 38 and the outer region in the horizontal surface of the wafer edge portion can be reduced without changing the area of contact between the polishing tape 38 and the inner region in the horizontal surface. The polishing tape 38 can therefore form the flat horizontal surface on the edge portion of the wafer W.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing method, comprising:

rotating a substrate;

first polishing the substrate by pressing a polishing tape against an edge portion of the substrate by a pressing member by applying movement in a direction approximately perpendicular to a top surface of the substrate, with a portion of the polishing tape projecting from the pressing member inwardly in a radial direction of the substrate, to form a step portion in the edge portion of the substrate and to bend the portion of the polishing tape along the pressing member; and second polishing the substrate by pressing the bent portion of the polishing tape inwardly in the radial direction of the substrate by the pressing member by applying movement in the radial direction of the substrate to polish a vertical surface of the step portion.

2. The polishing method according to claim 1, wherein the bent portion of the polishing tape is longer than a depth of the step portion formed in the edge portion of the substrate in said first polishing.

3. The polishing method according to claim 1, wherein at least one of said first polishing and said second polishing is performed while moving the polishing tape in its longitudinal direction.

4. The polishing method according to claim 3, wherein a movement direction of the polishing tape is opposite to a movement direction of the edge portion of the rotating substrate.

5. A polishing method, comprising:

rotating a substrate;

first polishing the substrate by pressing a polishing tape against an edge portion of the substrate by a pressing member, with a portion of the polishing tape projecting from the pressing member inwardly in a radial direction of the substrate, to form a step portion in the edge portion of the substrate;

after said first polishing, pressing the portion of the polishing tape against the step portion to bend the portion of the polishing tape along the pressing member; and second polishing the substrate by pressing the bent portion of the polishing tape inwardly in the radial direction of the substrate by the pressing member by applying movement in the radial direction of the substrate to polish a vertical surface of the step portion.

6. The polishing method according to claim 5, wherein at least one of said first polishing and said second polishing is performed while moving the polishing tape in its longitudinal direction.

7. The polishing method according to claim 6, wherein a movement direction of the polishing tape is opposite to a movement direction of the edge portion of the rotating substrate.

8. A polishing method, comprising:

rotating a substrate;

first polishing the substrate by pressing a first polishing tape against an edge portion of the substrate by a first pressing member, with a portion of the first polishing tape projecting from the first pressing member inwardly in a radial direction of the substrate, to form a step portion in the edge portion of the substrate;

positioning of second polishing tape and a second pressing member such that a portion of the second polishing tape projects from the second pressing member inwardly in the radial direction of the substrate;

pressing the portion of the second polishing tape against the step portion to bend the portion of the second polishing tape along the second pressing member; and second polishing the substrate by pressing the bent portion of the second polishing tape inwardly in the radial direction of the substrate by the second pressing member to polish a vertical surface of the step portion.

9. The polishing method according to claim 8, wherein performing said positioning comprises positioning the second polishing tape and the second pressing member such that an edge of the second pressing member is located radially outwardly of the vertical surface of the step portion and a horizontal distance between the edge of the second pressing member and the vertical surface is larger than a thickness of the second polishing tape.

10. The polishing method according to claim 8, wherein:

the first polishing tape is a rough polishing tape; and the second polishing tape is a fine polishing tape.

11. The polishing method according to claim 8, wherein said first polishing is performed while moving the first polishing tape in its longitudinal direction.

12. The polishing method according to claim 11, wherein a movement direction of the first polishing tape is opposite to a movement direction of the edge portion of the rotating substrate.

13. The polishing method according to claim 8, wherein said second polishing is performed while moving the second polishing tape in its longitudinal direction.

14. The polishing method according to claim 13, wherein a movement direction of the second polishing tape is opposite to a movement direction of the edge portion of the rotating substrate.

15. A polishing method, comprising:

rotating a substrate;

first polishing an edge portion of the substrate by pressing a polishing tool against the edge portion of the substrate in a direction substantially perpendicular to a flat surface of the substrate; and after said first polishing, second polishing the edge portion of the substrate by pressing the polishing tool inwardly in the radial direction of the substrate.

16. A polishing method, comprising:

rotating a substrate;

slide-polishing an edge portion of the substrate by pressing a polishing tape against the edge portion of the substrate in a direction substantially perpendicular to a flat surface of the substrate by a pressing member while moving the polishing tape and the pressing member inwardly in a radial direction of the substrate until the polishing tape reaches a predetermined stop position;

repeating said slide-polishing; and shifting slightly the stop position inwardly in the radial direction of the substrate each time said slide-polishing is performed.

17. A polishing method, comprising:

adjusting a pressing member in a position displaced along an inner edge of the pressing member by a predetermined distance such that an angle between the inner edge and a straight line, extending from a center of the substrate to a midpoint of the inner edge, is not a right angle as viewed from above the substrate;

locating the pressing member at the adjusted position;

rotating the substrate; and pressing a polishing tape against an edge portion of the substrate by the pressing member in the adjusted position to form a horizontal surface on the edge portion of the substrate.

18. The polishing method according to claim 17, wherein a polishing surface of the polishing tape when contacting the substrate is parallel to a surface of the substrate.

19. The polishing method according to claim 17, wherein the predetermined distance is less than half a length of the inner edge of the pressing member.

20. A polishing method comprising:

locating a pressing member in a position displaced in a tangential direction of a substrate by a predetermined distance from an origin position that lies on a center line extending in a radial direction from a center of the substrate, said tangential direction being perpendicular to the center line;

rotating the substrate; and pressing a polishing tape against an edge portion of the substrate by the pressing member in the displaced position to form a horizontal surface on the edge portion of the substrate, wherein the polishing tape extends in the tangential direction when viewed from above the substrate.

21. The polishing method according to claim 20, wherein pressing of the polishing tape comprises, with an edge of the pressing member coinciding with an edge of the polishing tape, pressing the polishing tape against the edge portion of the substrate by the edge of the pressing member in the displaced position.

22. The polishing method according to claim 20, wherein pressing of the polishing tape comprises, with a portion of the polishing tape projecting from an edge of the pressing member, pressing the polishing tape against the edge portion of the substrate by the pressing member in the displaced position.

23. The polishing method according to claim 17, wherein the polishing tape extends along the center line when viewed from above the substrate.

24. A polishing method, comprising:

adjusting a polishing tool in a position displaced along an inner edge of the polishing tool by a predetermined distance such that an angle between the inner edge and a straight line, extending from a center of the substrate to a midpoint of the inner edge, is not a right angle as viewed from above the substrate;

locating the polishing tool at the adjusted position;

rotating the substrate; and pressing the polishing tool in the adjusted position against an edge portion of the substrate to form a horizontal surface on the edge portion of the substrate.

25. A polishing method, comprising:

rotating a substrate;

first polishing the substrate by pressing a polishing tape against an edge portion of the substrate by a pressing member, with a portion of the polishing tape projecting from the pressing member inwardly in a radial direction of the substrate, to form a step portion in the edge portion of the substrate and to bend the portion of the polishing tape along the pressing member; and second polishing the substrate by pressing the bent portion of the polishing tape inwardly in the radial direction of the substrate by the pressing member after removing a pressing in a direction approximately perpendicular to a top surface of the substrate to polish a vertical surface of the step portion.

26. The polishing method according to claim 25, wherein the bent portion of the polishing tape is longer than a depth of the step portion formed in the edge portion of the substrate in said first polishing.

27. The polishing method according to claim 25, wherein at least one of said first polishing and said second polishing is performed while moving the polishing tape in its longitudinal direction.

28. The polishing method according to claim 27, wherein a movement direction of the polishing tape is opposite to a movement direction of the edge portion of the rotating substrate.

* * * * *